US011377267B2

(12) United States Patent
Ekkert

(10) Patent No.: US 11,377,267 B2
(45) Date of Patent: Jul. 5, 2022

(54) CHOKE-RESISTANT CLOSURE

(71) Applicant: PHOENIX CLOSURES, INC., Naperville, IL (US)

(72) Inventor: Len Ekkert, Lemont, IL (US)

(73) Assignee: PHOENIX CLOSURES, INC., Naperville, IL (US)

( * ) Notice: Subject to any disclaimer, the term of this patent is extended or adjusted under 35 U.S.C. 154(b) by 287 days.

(21) Appl. No.: 16/413,362

(22) Filed: May 15, 2019

(65) Prior Publication Data

US 2020/0361664 A1 Nov. 19, 2020

(51) Int. Cl.
*B65D 41/04* (2006.01)
*B65D 75/58* (2006.01)

(52) U.S. Cl.
CPC ..... *B65D 41/04* (2013.01); *B65D 75/5883* (2013.01); *B65D 2213/00* (2013.01); *B65D 2401/30* (2020.05)

(58) Field of Classification Search
CPC ..... B65D 41/04; B65D 2213/00; B65D 41/3409; B65D 75/5883; B65D 41/0485
See application file for complete search history.

(56) References Cited

U.S. PATENT DOCUMENTS 5,853,095 A * 12/1998 Marshall ..... B65D 41/3428 215/252
6,000,848 A 12/1999 Massioui
6,050,451 A 4/2000 Hess, III et al.
6,164,822 A 12/2000 Beer
6,241,122 B1 6/2001 Araki et al.
6,273,307 B1 8/2001 Gross et al.
(Continued)

FOREIGN PATENT DOCUMENTS

DE 102005028068 12/2006
EP 2653404 10/2013
WO 2006032326 3/2006

OTHER PUBLICATIONS

English translation of claims related to international publication WO2006032326, generated Jan. 2, 2016, EPO Patent Translate (2 pgs.).

(Continued)

*Primary Examiner* — James N Smalley
(74) *Attorney, Agent, or Firm* — Husch Blackwell LLP

(57) ABSTRACT

A closure includes: a cap member for engaging a fitment; a handling member wall encircling the cap member; and septa connecting the cap and handling members and providing an interior space between them. The handling member can include an upper rim smaller than its lower rim, and multiple openings, providing structures for allowing air flow into or out of the interior space. The openings and rims are aligned to provide multiple ventilation passageways traveling in: straight, vertical directions; straight, horizontal directions; indirect horizontal directions; or indirect transverse pathways that include vertical and horizontal orientations.
The closure can include a tamper-evident band for indicating the closure has disengaged from the fitment. The band can comprise indentations defining segments that the tamper-evident band can separate into when the closure disengages, and connecting elements that keep the intact tamper-evident band, and its separated segments, connected to the closure.

16 Claims, 32 Drawing Sheets

(56) References Cited

U.S. PATENT DOCUMENTS

| | | | | |
|---|---|---|---|---|
| 6,439,429 | B1 | 8/2002 | Gross | |
| 6,485,479 | B1 | 11/2002 | Kneirbein | |
| 6,860,406 | B2 | 3/2005 | Kobetsky et al. | |
| 7,172,100 | B2 | 2/2007 | Mertens | |
| 7,207,153 | B1 | 4/2007 | Malin | |
| 7,350,669 | B2 | 4/2008 | Rani | |
| 7,762,414 | B2 | 7/2010 | Uytterhaeghe et al. | |
| 7,762,430 | B2 | 7/2010 | Wild et al. | |
| 7,850,044 | B2 | 12/2010 | Hildebrand et al. | |
| 8,292,121 | B2 | 10/2012 | Davideit et al. | |
| 8,443,999 | B1 * | 5/2013 | Reinders | B65D 41/0485 220/303 |
| 8,459,512 | B2 | 6/2013 | Arvizu | |
| 8,528,758 | B2 | 9/2013 | Morlot et al. | |
| 8,613,548 | B2 | 12/2013 | Murray | |
| 8,672,182 | B2 | 3/2014 | Bonet Pedrol | |
| 8,777,058 | B2 | 7/2014 | Haefele et al. | |
| 9,132,944 | B2 | 9/2015 | Schick | |
| 9,221,592 | B2 | 12/2015 | Murray | |
| 2006/0201967 | A1 | 9/2006 | Romer | |
| 2009/0139993 | A1 | 6/2009 | Last | |
| 2009/0223963 | A1 * | 9/2009 | Bisio | B65D 41/3433 220/304 |
| 2009/0255626 | A1 | 10/2009 | Murray | |
| 2013/0153528 | A1 * | 6/2013 | Luo | B65D 55/00 215/201 |
| 2013/0284769 | A1 | 10/2013 | Schick | |
| 2015/0048112 | A1 | 2/2015 | Skillin et al. | |
| 2015/0284145 | A1 | 10/2015 | Arimoto et al. | |
| 2016/0122095 | A1 * | 5/2016 | Berge | B65D 75/008 222/92 |
| 2018/0170626 | A1 * | 6/2018 | Kwon | B65D 41/3404 |

OTHER PUBLICATIONS

English translation of description related to international publication WO2006032326, generated Jan. 2, 2016, EPO Patent Translate (3 pgs.).

English translation of claims related to German publication DE102005028068, generated Jan. 2, 2016, EPO Patent Translate (2 pgs.).

English translation of description related to German publication DE 102005028068, generated Jan. 2, 2016, EPO Patent Translate (4 pgs.).

* cited by examiner

1/32

CHOKE-RESISTANT CLOSURE

BACKGROUND

Many food and beverage containers can dispense their contents into the mouth of a user. Such containers can include features that encourage users to place a dispensing portion of the container directly into their mouths, such as a straw or mouthpiece. But even where containers are designed to discourage a user from placing a part of the container into his mouth, infants and small children can nonetheless swallow small parts of the container, such as a container closure.

This invention relates to closures or caps that are designed to be mounted onto containers, or onto fitment portions of such containers, particularly onto containers that dispense their contents directly into the mouth of a user. For example, single-sized pouches of liquid or food sometimes use such closures.

It is important that closures and caps not pose a choking hazard to the user after they are removed from their containers, especially components associated with food and beverage containers. It is also important that the caps not pose a choking hazard to another individual, especially a toddler or infant, who encounters a discarded cap and swallows it.

Presently, some caps include openings to allow the flow of air through the cap when the cap is lodged in the throat of an individual. It is desirable for a closure to have passageways that are sufficient in number and size to facilitate the flow of sufficient air to that individual in distress, so that the individual continues to get enough air until efforts to remove the cap are successful. Particularly desired are closures with multiple ventilation passageways configured to allow airflow even when one side of the closure is completely obstructed. And perhaps even more desired, are closures whose multiple passageways are configured to allow airflow even when any one side of the closure (top side, bottom side, or lateral side) is completely obstructed. Also desired are closures whose multiple passageways are configured to allow airflow where more than one side of the closure is partially blocked, or where every side of the closure is partially blocked.

It is also desired for multiple ventilation passages to be configured within the cap in such a way as to allow the flow of air through at least one of the ventilation passages in the cap, regardless of the orientation of the cap in the individual's airway. There is a need for a cap having multiple ventilation passages in oriented in multiple directions, to allow air flow through the cap whether it is lodged topside-up, upside-down, or sideways, or lies at an angle with the individual's airway. It is also important that the cap support be configured to provide continued air flow to accommodate changes in the orientation of the affected individual, such can occur in moving the affected individual from an upright to a prone position to administer aid, or when unsuccessful attempts to dislodge the closure instead result in shifting the closure to a different position or orientation within the individual's airway.

It is desired that such ventilation passages that are designed in such a way that air flow through the closure is possible even where different portions of the closure are completely obstructed. There is a particular need for closures whose ventilation passages are designed to allow vertical, horizontal, and indirect paths of airflow through the cap regardless of its position within an individual's airway, and regardless of the orientation of the individual.

It is also desirable for a closure to include a tamper-evident band that can be attached to the cap such that when the cap is removed from a container, the tamper-evident band changes conformation in a way that signals that the cap has been unsealed, but remains connected to the closure so that that tamper-evident band does not pose a different choking hazard to a user.

There is a need for closures that helps individual identify food and beverage containers that might not be safe for consumption, and to minimize the choking risk that exists for every closure (and every closure component) component small enough to fit in a person's mouth.

SUMMARY OF THE INVENTION

A main aspect of the invention relates to a closure for engaging a container, the closure comprising: (a) a cap member having a top wall, and a peripheral wall depending from the top wall, the cap member for engaging the container; (b) a handling wall member disposed around the peripheral wall, the handling wall member comprising: (i) first and second ends, each end having an aperture bounded by a rim, a perimeter of the first end being smaller than a perimeter of the second end; and (ii) a plurality of openings, each opening providing a passageway through a portion of the handling wall member; (c) a plurality of septa connecting the handling wall member to the peripheral wall; (d) a first vertical ventilation passage extending in a straight vertical line between the peripheral wall and the handling member, the first vertical ventilation passage for conveying air through a top end of the closure, between the top and peripheral walls, and through a bottom end of the closure bottom; (e) a plurality of second vertical ventilation passages, each second vertical ventilation passage extending in a straight vertical line, each second vertical ventilation passage for conveying air through a corresponding opening, between the handling wall member and the peripheral wall, and through the second end of the handling wall member; and (f) a plurality of horizontal ventilation passages, each first horizontal ventilation passage extending in a horizontal path between a first opening and a second opening, for conveying air into the closure via the first opening and out of the closure via the second opening; such that when any one side of the closure is fully obstructed, air can flow through the closure through at least one of the ventilation passages.

An additional aspect includes the closure comprising a plurality of transverse ventilation pathways, wherein at least one transverse ventilation pathway is for conveying air in an indirect path between the first and second openings; such that the indirect path includes conveying the air around the septum. Further aspects relate to the closure such that the septum includes an upper surface and a lower surface; such that the transverse ventilation pathway is for conveying air around the upper and lower surfaces of the septum.

Another aspect of the closure includes a tamper-evident band proximate to a bottom of the peripheral wall, comprising: a) a plurality of segments joined together to form the band, each end of each segment defining an indentation on an outer surface of the tamper-evident band, each segment attached to the peripheral wall bottom by at least one connecting element; b) the at least one connecting element; and c) at least one engagement element i) extending inward from an inner surface of the tamper-evident band and ii) adapted to engage a receptive portion of the container, thereby to cause the tamper-evident band to i) tear along the indentation and ii) separate the segments, for indicating that the container has been disengaged from the closure.

Additional aspects of the closure include each segment attached to the peripheral wall bottom by at least one of the following: the at least one connecting element and the septum.

Other aspects of the closure include the connecting elements connecting an inner surface of the tamper-evident band to an outer surface of the peripheral wall.

Still other aspects of the closure include each indentation located on the outer surface of the band, and each indentation extending between an upper and lower edge of the band.

Yet other aspects of the closure include the tamper-evident band defining a continuous surface surrounding the bottom end of the peripheral wall.

Another main aspect of the invention relates to a closure adapted to be engaged to a fitment, the closure having a top side, a bottom side, and a lateral side between the top and bottom sides, the closure comprising: (a) a cap member having a top wall, and a peripheral wall depending from the top wall, the cap member for engaging the fitment; (b) a handling member having: i) a handling wall surrounding the peripheral wall; ii) a top end having an upper handling member rim surrounding a first aperture, and a bottom end having a lower handling member rim surrounding a second aperture, a circumference of the upper handling member rim being smaller than a circumference of the lower handling member rim; and iii) an opening being located in the handling wall, each opening extending between the interior and exterior surfaces of the handling wall, each opening bounded by the handling wall, each opening being located between the top and bottom ends of the handling member, and each opening defining a passageway for conveying air between the inner and outer surfaces of the handling wall; wherein the peripheral wall and the handling wall provide define first and second lateral boundaries of a cavity within the closure, an upper end of the cavity defined by the upper handling member rim, and a lower end of the cavity defined by the lower handling member rim; (c) a septum connecting the handling wall and the peripheral wall to each other; (d) a first ventilation passage extending in a direct line between the peripheral wall and the handling member, the first ventilation passage for conveying air through the closure top side, the cavity, and the closure bottom side; (e) a second ventilation passage extending in a direct line through the opening, the at least second ventilation passage for conveying air through the handling wall, the cavity, and the closure bottom side, the first and second ventilation passages extending parallel to each other; and (f) a third ventilation passage extending in an indirect path between a first opening and a second opening, for conveying air in the first opening into the cavity, around a septum, to the second opening, the third ventilation passage extending in a direction transverse to first and second ventilation passages; such that when any closure side is fully obstructed, air can flow through the closure through at least one of the first, second, and third ventilation passages.

Another aspect of the closure includes the first ventilation passage for conveying air through the upper handling member rim, t'he cavity, and the lower handling member rim.

An additional aspect of the closure includes the second ventilation passage for conveying air through the opening in the handling wall, the cavity, and the lower handling member rim.

Other aspects of the closure include the septum comprising an upper surface and a lower surface; such that the third ventilation passage is for conveying air around the upper and lower surfaces of the septum.

An additional aspect of the closure includes a fourth ventilation passage extending in a direct line between a pair of the openings.

Other aspects of the closure include the septum dividing the first ventilation passage into a plurality of first ventilation passages.

Still other aspects of the closure include a tamper-evident band proximate to the bottom end of the peripheral wall, comprising: i) a plurality of segments joined together to form a ring, the band having an outer surface and an inner surface; ii) at least one indentations, each indentation defining an end of the segment; iii) a plurality of connecting elements; each segment attached to at least one of the following: the connecting element and the septum; and iv) at least one engagement element extending toward the peripheral wall and adapted to engage a receptive portion of the fitment, thereby to cause breakage of the tamper-evident band along the at least one indentation, for indicating that the fitment has been disengaged from the fitment.

Further aspects of the closure include the connecting elements connecting an inner surface of the tamper-evident band to an outer surface of the peripheral wall. Other further aspects of the closure include each indentation located on the outer surface of the band, and each indentation extending between an upper and lower edge of the band. Yet other further aspects of the closure include the tamper-evident band defining a continuous surface surrounding the bottom end of the peripheral wall.

Another main aspect of the invention relates to a closure for engaging a fitment, the closure comprising: (a) a cap member having a top wall, and a peripheral wall depending from the top wall; (b) a handling wall member encircling the peripheral wall, the handling wall member comprising: first and second ends, a perimeter of the first end being smaller than a perimeter of the second end; and a plurality of openings, each opening located within the handling wall member and between the first and second ends; (c) a plurality of septa connecting the handling wall member to the peripheral wall, each septa having an upper surface and a lower surface; (d) at least one first ventilation passage extending between the peripheral wall and the handling member, the first ventilation passage for conveying air through an upper portion of the closure, between the top and peripheral walls, and through a lower portion of the closure; (e) a plurality of second ventilation passages, the second ventilation passage for conveying air through a corresponding opening, between the handling wall member and the peripheral wall, and through the second end of the handling wall member; (f) a plurality of transverse ventilation pathways, each transverse ventilation pathway for conveying air in an indirect path between a first pair of openings, the pathway for conveying air around the upper and lower surfaces of the septa; and (g) a tamper-evident band proximate to the bottom of the peripheral wall, comprising: i) a plurality of segments, each segment defined by an indentation on an outer surface of the tamper-evident band, each segment attached to the peripheral wall bottom by at least one connecting element; ii) plurality of connecting elements; and iii) at least one engagement element adapted to engage the fitment, thereby to cause the indentations to tear and the tamper-evident band to separate into segments, for indicating that the closure has been disengaged from the fitment; such that when any one outer surface of the closure is fully obstructed, air can flow through the closure through at least one of the ventilation passages.

Other aspects of the closure include a plurality of third ventilation passages, each third ventilation passage extending between a second pair of openings, for conveying air between the second pair of openings.

BRIEF DESCRIPTION OF THE DRAWINGS

FIG. 1A shows a bottom perspective view of the secured closure and fitment, FIG. 1B shows a close-up perspective view of the closure attached to the fitment, FIG. 1C shows a cross-sectional view of the closure secured to the fitment, and FIG. 1D shows a bottom perspective view of the closure secured to the fitment;

FIG. 2A shows a top perspective view of the closure, FIG. 2B shows a side perspective view of the closure, FIG. 2C shows a top view of the closure and illustrates vertical ventilation passages located between a cap member and a handling member of the closure, FIG. 2D shows a bottom view of the closure and illustrates the vertical ventilation passages located between the cap member and the handling member of the closure, FIG. 2E shows a top perspective view of the closure illustrating the vertical airflow located between upper and lower rims of the handling member that is afforded by openings in the handling member, and FIG. 2F shows a bottom perspective view of the closure, showing the connection between the cap member and a tamper-evident band.

FIG. 3A shows a top perspective view of a choke-resistant closure, FIG. 3B shows a bottom perspective view of the closure, FIG. 3C shows a top view of the closure, and FIG. 3D shows a bottom view of the closure;

FIG. 4A shows a bottom perspective view of a choke-resistant closure, FIG. 4B shows a top view of the closure, FIG. 3C shows a bottom view of the closure;

FIG. 5A shows a cross-sectional view of the closure secured to a fitment, and FIG. 5B shows a bottom perspective view of the closure secured to the fitment;

FIG. 6A shows a cross-sectional view of a closure, FIG. 6B shows a perspective side view of a closure, and FIG. 6C shows a top view of a closure;

DETAILED DESCRIPTION OF PREFERRED EMBODIMENTS

Figure 1A:
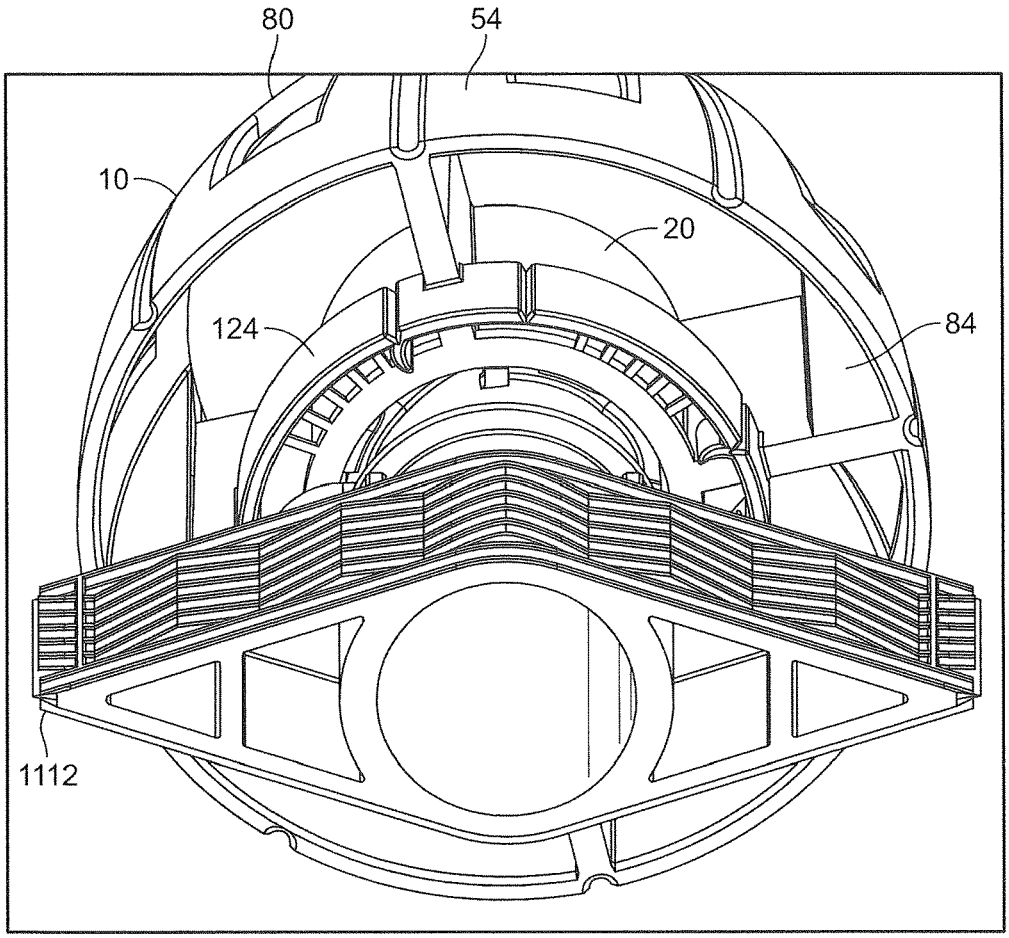
FIGS. 1A-1D shows views of an embodiment of a choke-resistant closure mounted onto a coupling member of a fitting element (or fitment) that connects the closure to the container.

Embodiments of the present invention can be used for any type of container or for any type of fitment that facilitates an indirect connection of a closure to a container.

FIGS. 1A-1D generally show an embodiment of a choke-resistant closure (10) or cap that is mounted onto or secured upon a fitment (1112). In a central portion (14), the closure (10) can include a cap member (20) for communicating with the fitment (1112). The cap member (20) can cover or seal the fitment (1112) to prevent to fitment (1112) from dispensing liquids or particles. The cap member (20) can be surrounded or encircled by a handling member (54), a wall-like structure by which a user can touch and manipulate the closure (10). The cap member (20) and handling member (54) can be connected by one or more partitions or septa (84). Each septum (84) can position the handling member (54) so that the cap member (20) and handling member (54) do not touch each other.

The closure can include a tamper-evident band (124) located around an end of the cap member (20).

Exemplary of fitments which are contemplated, and so illustrated in FIGS. 1A-1D, are for connecting to a wide variety of containers including water bottles, juice bottles, juice boxes, food pouches, plastic and metal cans, bags, squeezable tubes, and the like.

An exemplary fitment can have an outer surface facing the ambient environment, and an inner surface facing an internal space or cavity or duct which is used to transfer a flowable material, such as a fluid or a particle, into or out of a connected container. The fitment can have a portion for connecting to the container and a portion for connecting with the closure. The closure-connecting portion can include a mouth or opening for dispensing the flowable material. The container-connecting portion can be part of a container, or can be a separate element which is separately connected to or mounted onto the container.

Embodiments of the Closure

As particularly shown in FIGS. 1-9, the closure (10) can be adapted to several embodiments. The closure (10) can include: a cap member (20) for engaging a container; a handling member (54) to enable a user to handle and manipulate the closure (10); one or more septa (84) to connect the cap (20) and handling (54) members and to define a cavity (106) between them; and/or a tamper-evident band (124) to signal to a user that the closure (10) has been opened or unsealed.

The cap member (20) can include a top wall (22), which can have a generally flat, planar surface (48) and a peripheral wall (34) depending from the top wall (22). One end of a peripheral wall (36) can join the periphery of the top wall, while the opposite end (38) of the peripheral wall (34) can define a mouth or aperture (42). The opposite end (38) of the peripheral wall (34) can include a cap rim (40), the cap rim (40) defining the outer edge or boundary (38) of the aperture (42). The cap rim (40) can define a continuous rim. The cap rim (40) can occupy a plane that is parallel to the top wall (22). The peripheral wall (34) can have an interior surface (46) that faces an internal portion of the closure (12) and an exterior surface (48) for facing the external environment surrounding the closure (10) (and facing the handling member (54)).

Figure 2A:
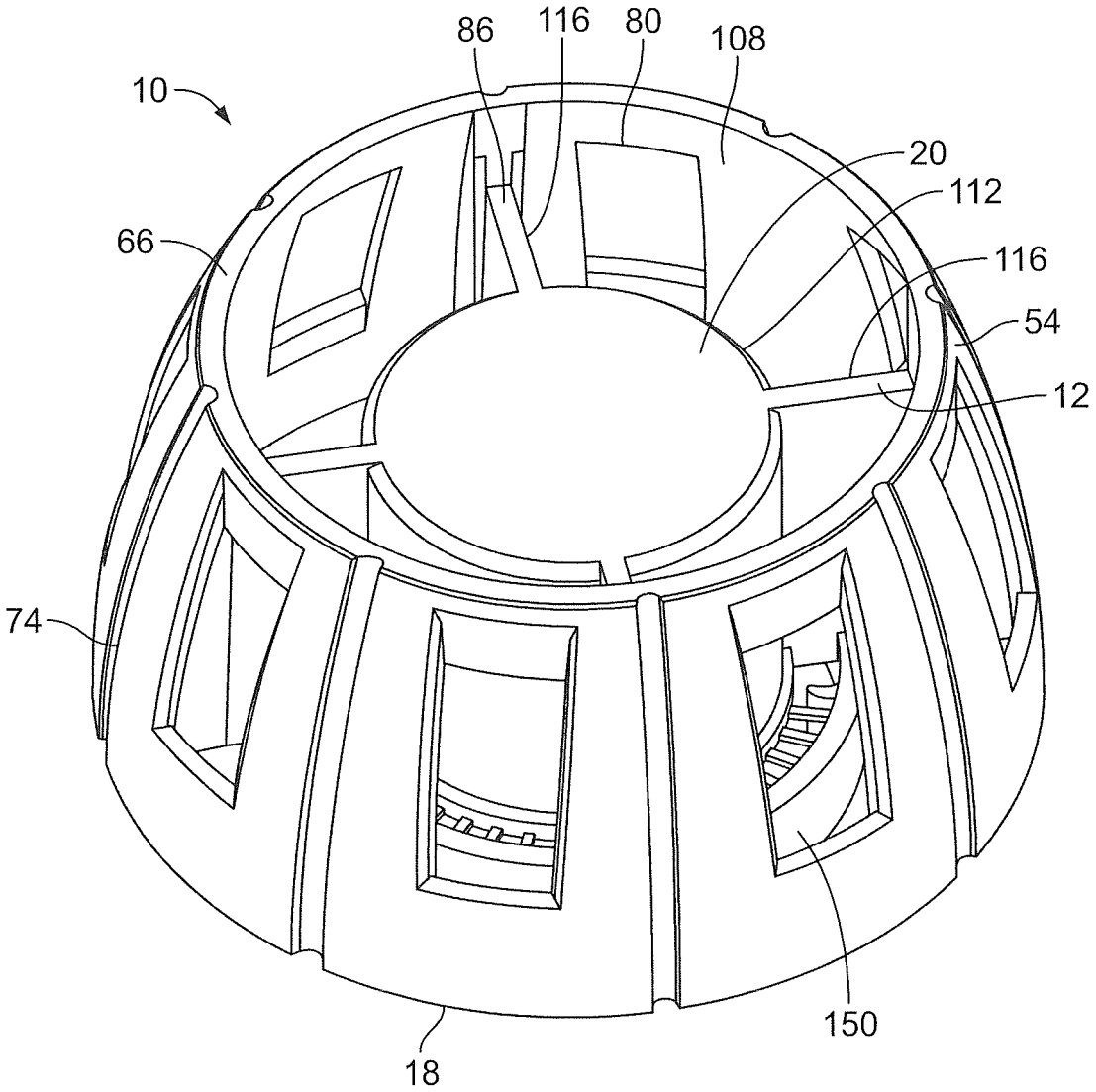
FIGS. 2A-2F shows an embodiment of a choke-resistant closure.
Figure 2B:
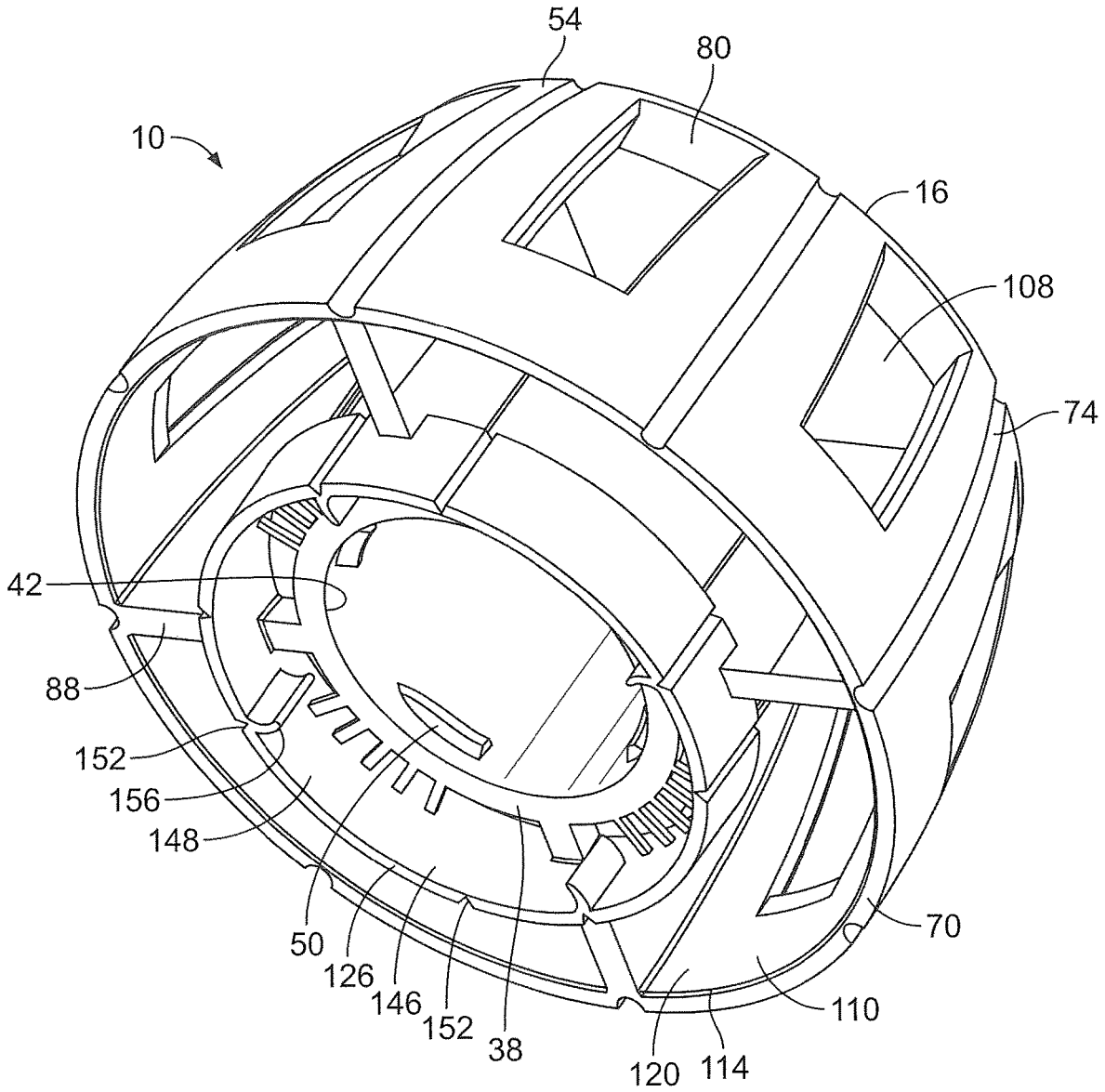
Figure 2C:
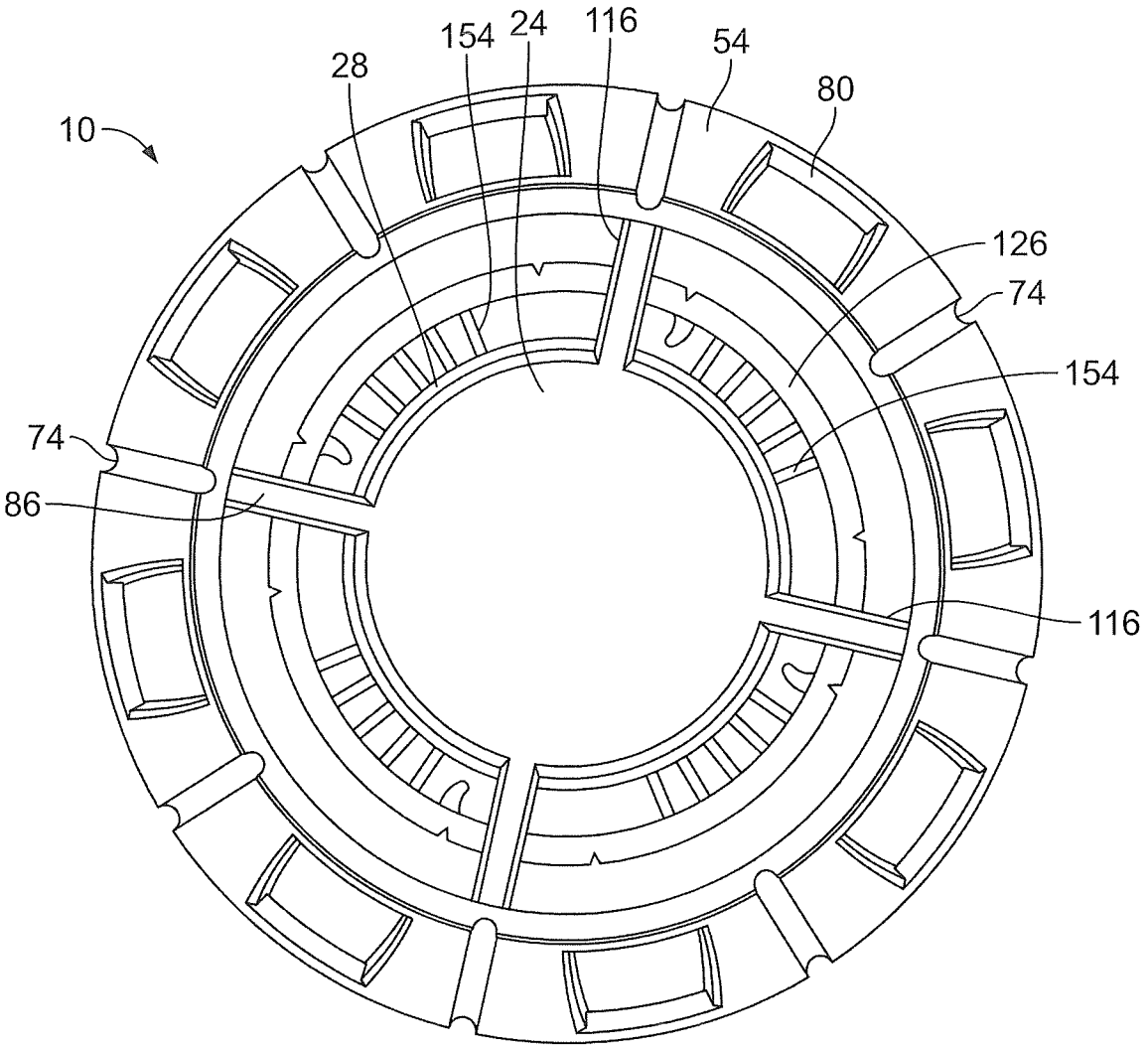
Figure 2D:
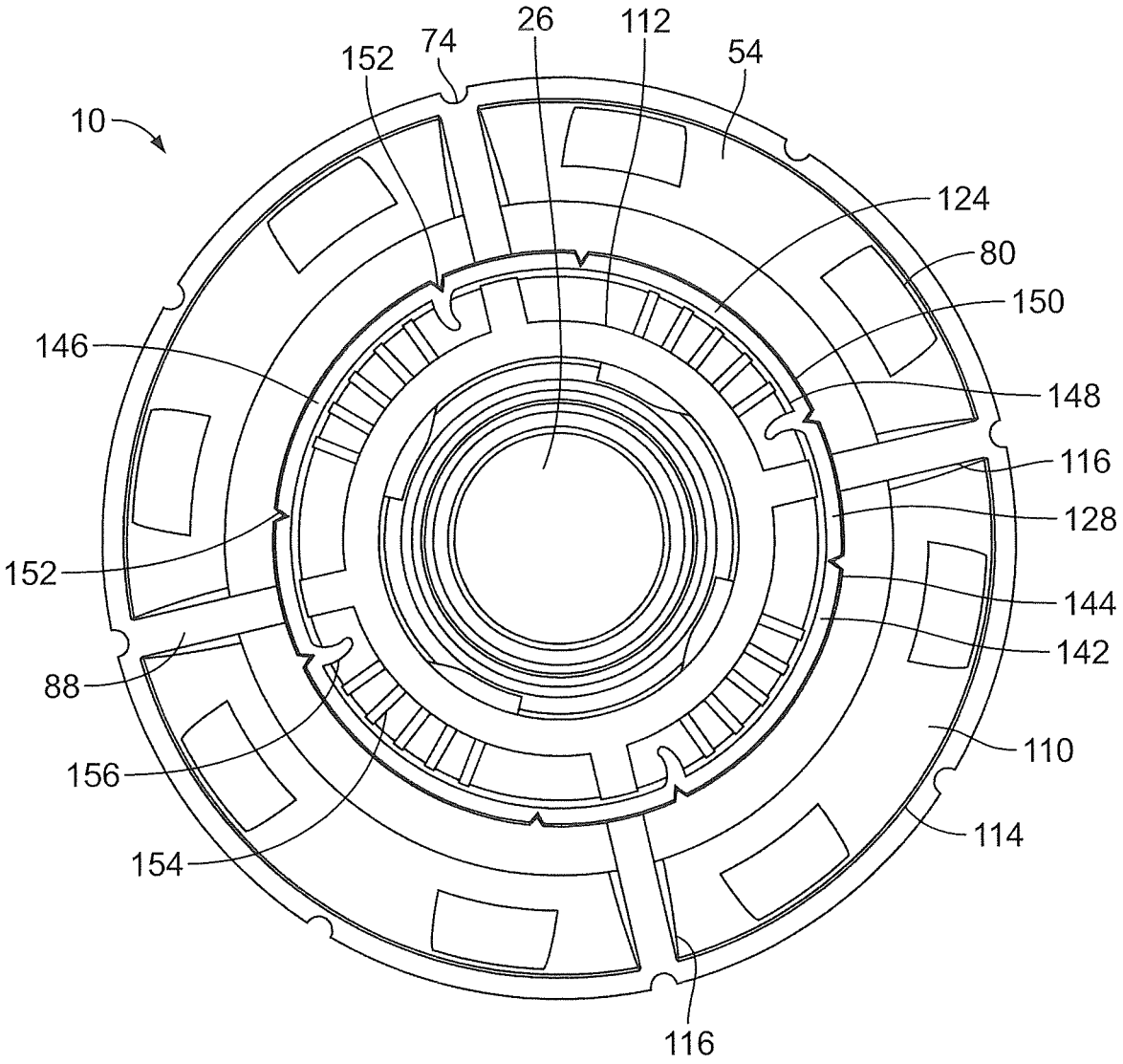
Figure 2E:
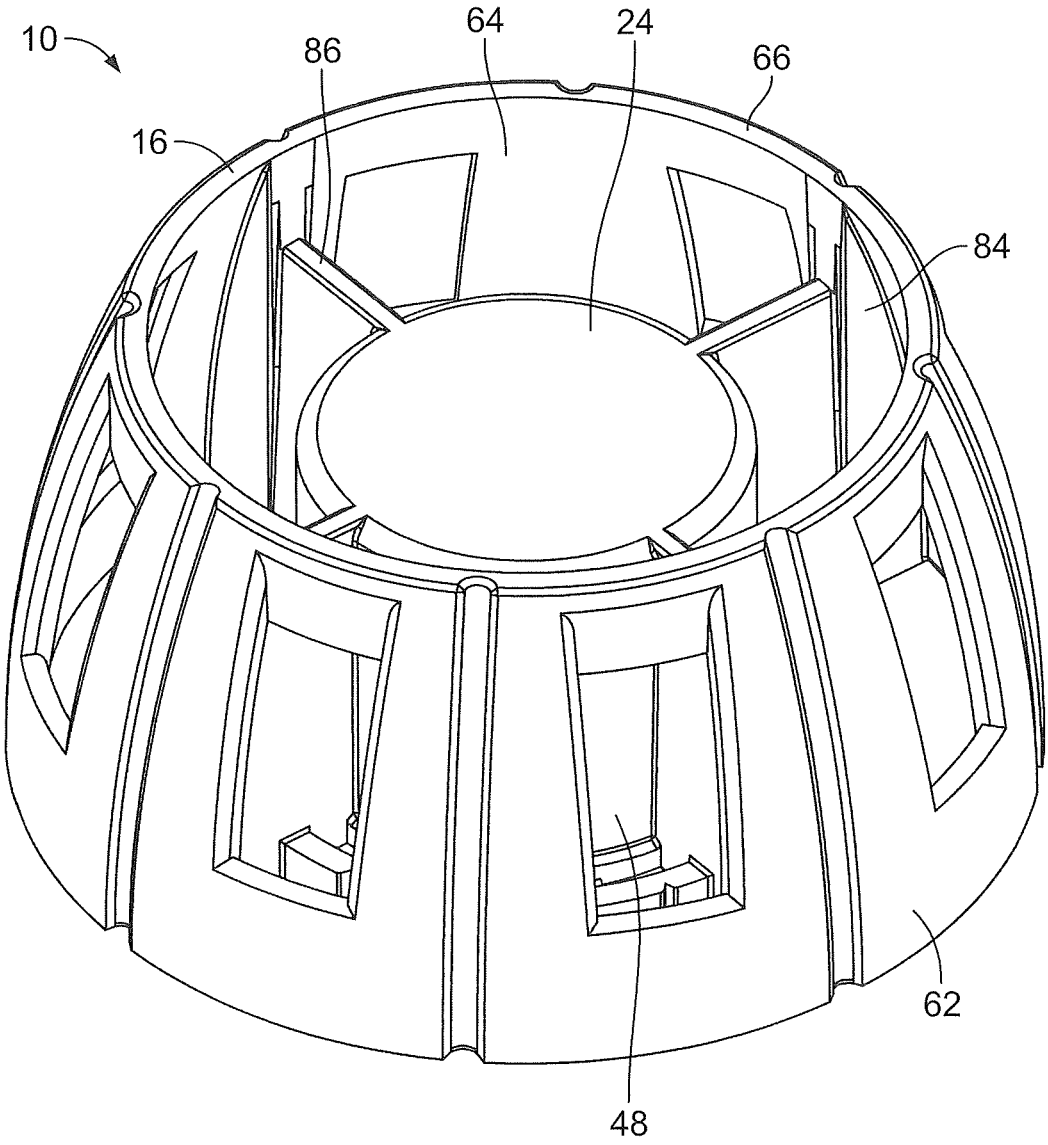

As shown in FIGS. 2A and 2D, the cap member (20) can have a circular shape or profile, though the cap member (20) can adopt the shape or profile of any regular polygon, such as a square, rectangle, or hexagon, or an irregular polygon. A cap member (20) can adopt an oval or elliptical shape or profile. The peripheral wall (34) can depend outward from the top wall (22), and be positioned to be generally perpendicular the top wall (22). It is preferred that the top wall (22) and the peripheral wall (34) have a diameter or perimeter of the same or similar length.

Figure 1B:
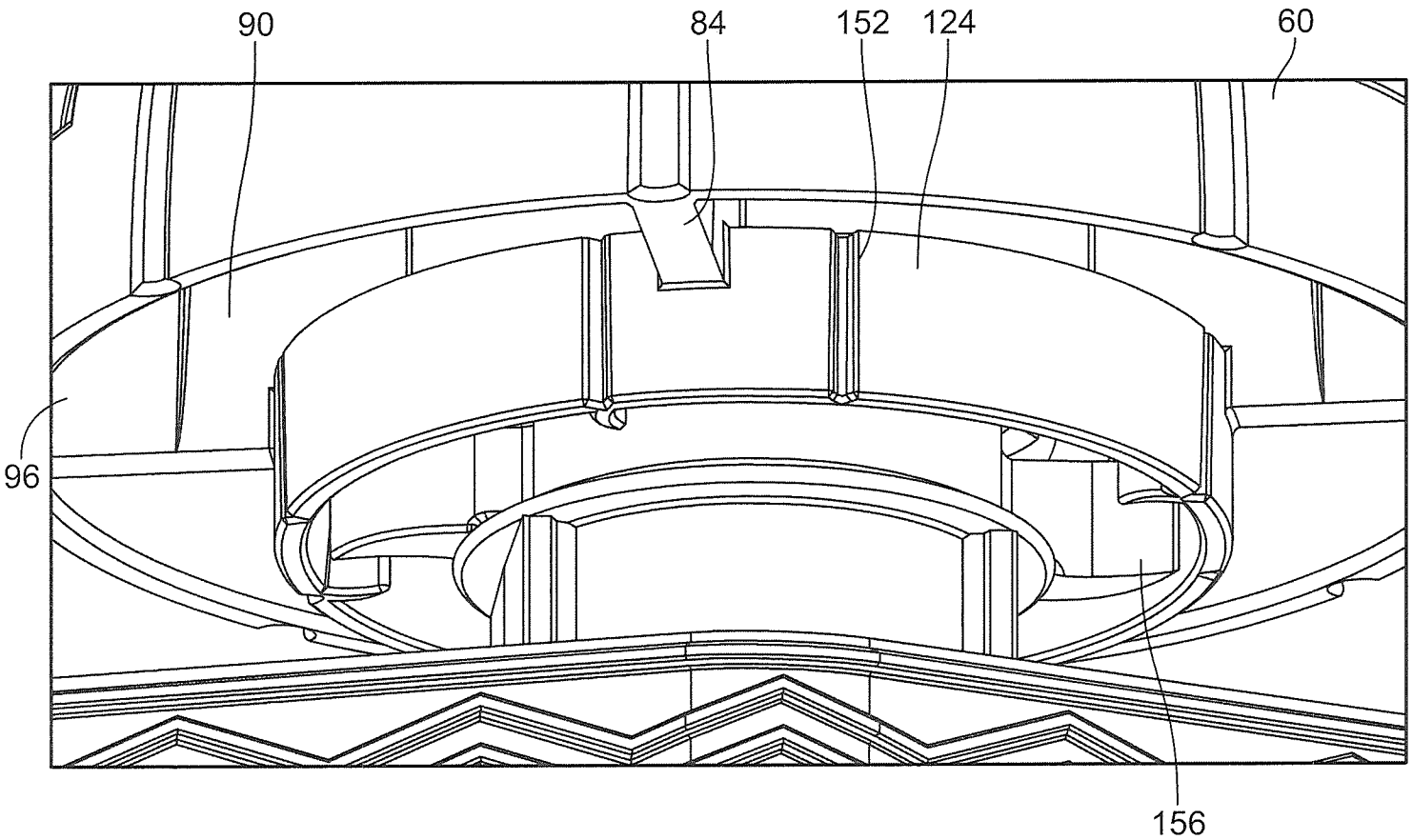
Figure 1C:
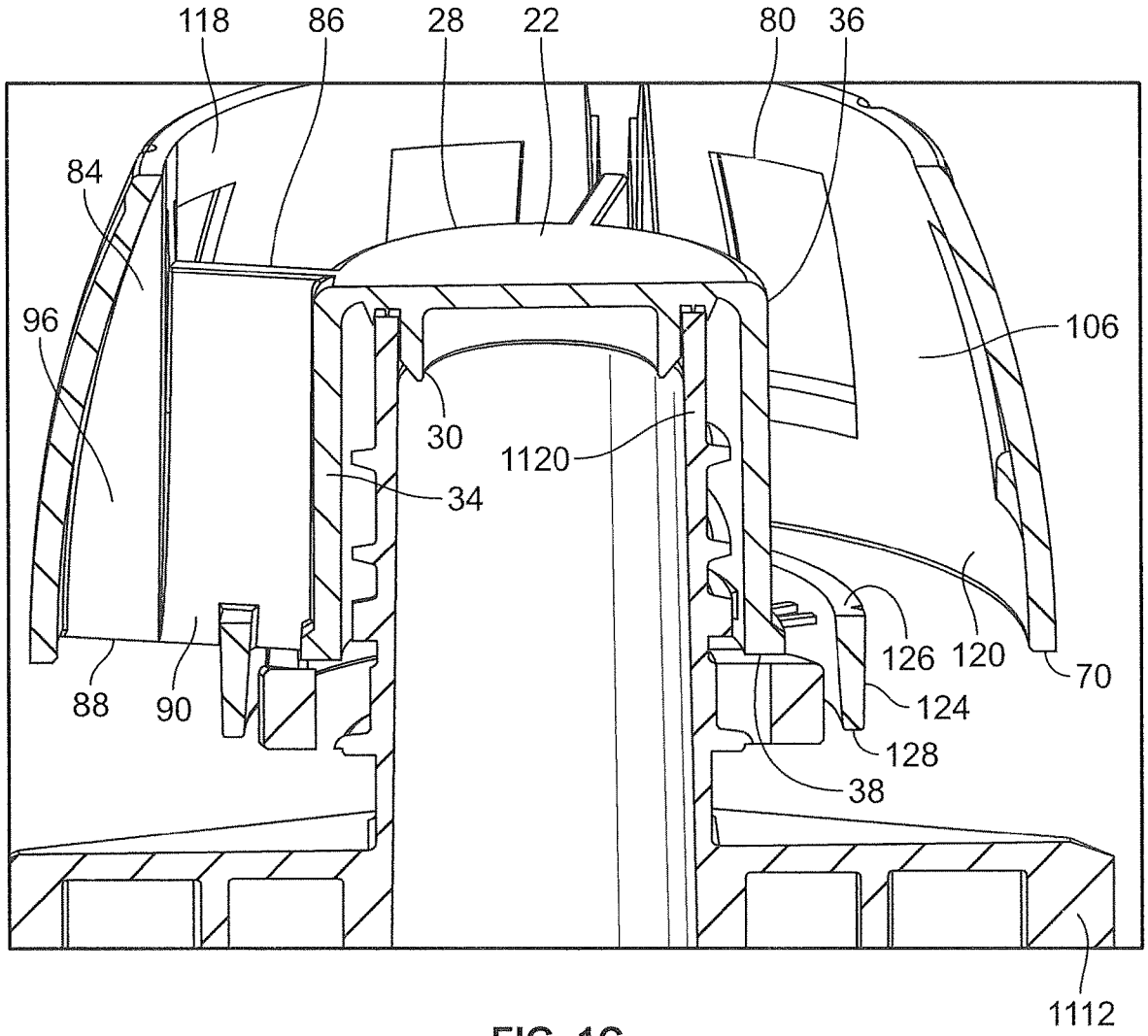
Figure 1D:
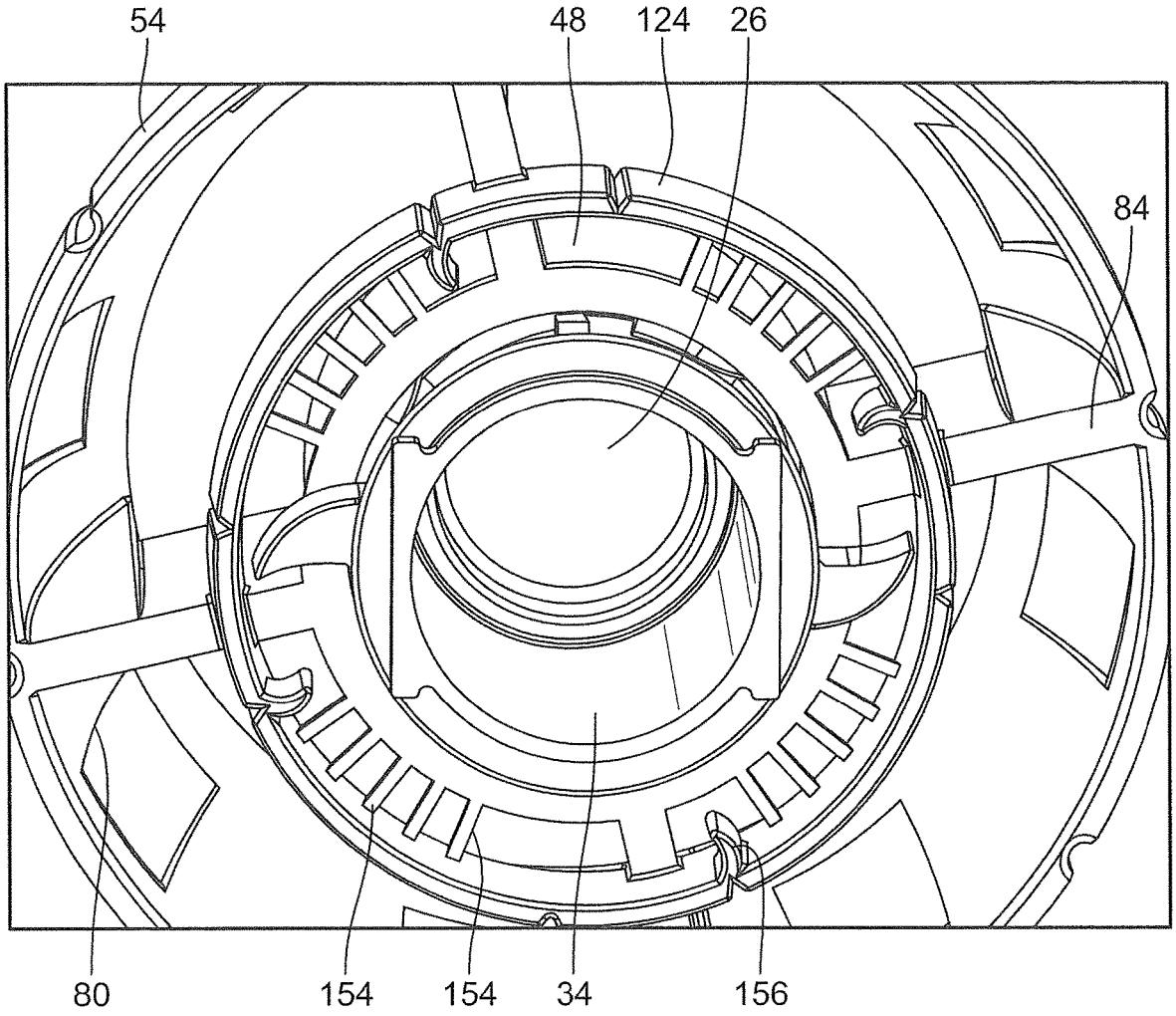

As shown in FIG. 1C, the cap member (20) can include an inner wall (30) for engaging the fitment (1112) or container, although other embodiments can engage the fitment (1112) via structures on the outer wall of the cap member (20). Such an engagement wall (30) can include a wall depending from the inner surface of the top wall (26). Whereas a peripheral wall (34) can depend from a peripheral (28) or outer portion (24) of the top wall, an engagement wall (30) can depend from a central portion of the top wall (26). In embodiments like those shown in FIG. 1C, the engagement wall (30) can be oriented to run parallel to a longitudinal axis of the cap member (20) or the closure (10), and can be oriented to run parallel to the peripheral wall (34). The engagement wall (30) is for engaging the dispensing portion of a fitment (1112) or container, for providing a cover or seal to the associated fitment (1112) or container. Other types of engagement elements could include a thread (44), a bead, or any other structure commonly used to mount closures (10) to fitments (1112) and containers. Such engagement elements are not limited to the top wall (22), but can be found on the peripheral wall (34) or other structures of the cap member (20). It is preferred that the closure (10) be adapted to be engaged to a receptive portion of the fitment (1112) or container to provide a seal that is air-tight or water-tight.

Figure 2F:
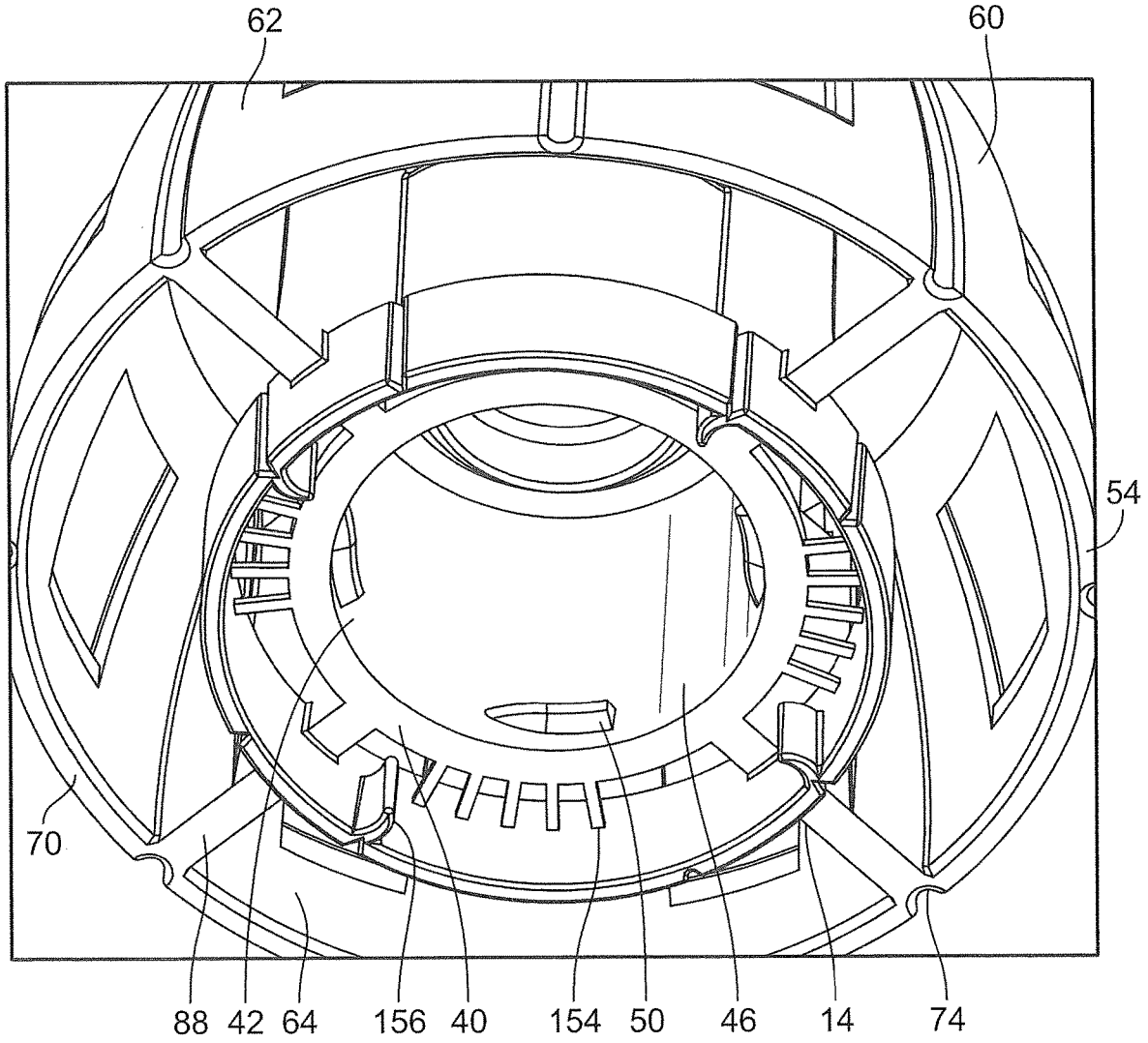

As shown in FIGS. 2B and 2F, the cap member (20) can also include, preferably on its inner face (46), one or more stopping elements (50), the stopping elements (50) for engaging corresponding structures on a fitment (1112) or container when the closure (10) (and the cap member (20)) is placed to engage the fitment (1112) or container. Such stopping elements (50) can communicate with the fitment (1112) or closure (10) to effect the communication of the closure (10) to the container or fitment (1112). Such stopping elements (50) can be used to provide a sealing engagement between the closure (10) and the container or fitment (1112), or a loose communication. Each stopping element (50) can include a protrusion extending outward from a face (142) of the tamper-evident band (124), preferably toward another structure. As shown in FIGS. 2B and 2F, a stopping element (50) can define a shelf extending inward from the peripheral wall (34). As shown here, the stopping element (50) can adopt a triangular shape or bullet shape.

In some other embodiments, a stopping element (50) can define a protruding structure extending from the outer surface (24) of the cap member (20), extending toward the container or fitment (1112). The stopping element (50) can define a structure that communicates with the container or fitment (1112). Stopping elements (50) can take a variety of shapes and sizes, for example, a bead, a hook, a shelf, and the like. Where there are multiple stopping elements (50), it is preferred that they have the same size and shape, are located on a common plane that is preferably perpendicular to a longitudinal axis of the cap member (20), are oriented in the same direction, and/or are regularly or equally spaced apart from each other.

The closure (10) can include a handling member (54) situated to surround the cap member (20). The handling member (54) can include a generally flat, continuous handling wall (60) surrounding an open space or cavity (106), the cavity (106) in turn surrounding the cap member (20). The handling wall (60) can have a top end (66) and bottom end (70), and an interior surface (64) that faces toward the cap member (20) and an exterior surface (62) that faces away from the cap member (20). The handling wall (60) can have a diameter or perimeter that is greater than the diameter or perimeter of the peripheral wall (34) of the cap member (20). When viewed from above or below, the handling member (54) can define a ring or band (124) outside the cap member (20), where the handling and cap members do not directly contact each other.

Opposite ends of the handling wall (60) can define upper and lower handling member rims (66,70). For example, as shown in FIGS. 2A-2D, an upper end of the handling wall (60) can define a continuous upper handling member rim (66) at the upper end, the upper handling member rim (66) defining an upper mouth or aperture (68) of the cavity (106) enclosed by the handling wall (60). A lower end of the handling wall (60) can define a continuous lower handling member rim (70) at the opposite lower end, the lower handling member rim (70) defining a lower mouth or aperture (72) of the cavity (106) enclosed by the handling wall (60). In other embodiments, either or both rims can define irregular surfaces.

The cavity (106) can occupy a space whose volume can be bounded on a first or top end (108) by the upper handling member rim (66), and can be defined on a second or bottom end (110) by the lower handling member rim (70). An outer boundary (114) of the cavity (106) can be defined by the handling wall (60), particularly the inner surface (64) of the handling wall (60), and an inner boundary (112) of the cavity (106) can be provided by the peripheral wall (34), particularly the outer surface (48) of the peripheral wall (34).

One or more septum/septa (84) extending between the handling wall (60) and the peripheral wall (34) can provide define first and second lateral boundaries (116) of a smaller sub-cavity within the cavity (106) within the closure (10).

It is preferred that the height of the handling wall (60) be a height that is greater than the height of the cap member (20). As shown in FIG. 1C, the cap rim (40) and lower handling member rim (70) can occupy the same plane or planes that are parallel to each other. It is preferred that, when viewed from the side, the upper handling member rim (66) extend to a height above the height of the top wall (22) of the cap member (20).

The cap and handling members (54) can be connected to each other by one or more septa (84). Each septum (84) can define a generally flat, wall-like surface that spans between the cap (20) and handling members (54). Each pair of neighboring septa (84) can divide a portion of the cavity between the handling wall (54) and the peripheral wall (34) of the cap member (20) from a primary vertical ventilation passage (222), into smaller or narrower sub-passages (224).

The primary vertical ventilation passage (222) can define a straight or direct pathway for conveying air flow from the top end (16) of the closure to the bottom end (18) of the closure, when viewed from above or below as shown in FIGS. 2C-2D, and vice-versa. The primary vertical ventilation passage (222) can pass between i) the peripheral wall (34) of the cap member (20) and ii) the inner surface (64) of the handling member (54). As shown in FIGS. 2C-2D, where there are four septa (84), they can divide the primary vertical ventilation passage (222) into four primary vertical ventilation sub-passages (224). Each primary vertical ventilation sub-passage (224) can be bounded on a first end by the upper handling member rim (66), and bounded on a second end by the lower handling member rim (70). Each primary vertical ventilation passage (222) can extend in a straight or direct line through the interior (e.g., the cavity (106)) of the closure (10), with lateral sides defined by the septa (84).

It is preferred that the septa (84) be arranged on radial paths, the lines defined by the septa (84) meeting at a common point if the lines extended inward. It is also preferred that the septa (84) be spaced apart at regular distances, for example, arranged to be equidistant from each other. Where the septa (84) have a radial arrangement, it is preferred that their connection sites to the cap member (20) be equidistant from each other. Where the septa (84) have a radial arrangement, it is preferred that their connection sites to the handling member (54) be equidistant from each other.

In some embodiments, the septa (84) can be arranged in a transverse, non-radial orientation between the peripheral wall (34) and the handling wall (60).

As shown in FIG. 1C, each septa (84) can comprise an inner segment (90) and an outer segment (96). Each segment can generally include a flat, planar, wall-like surface. An interior end of the inner segment (90) can join the outer surface of the peripheral wall (34), preferably along a plane that is parallel to a longitudinal axis of the cap member (20). The end opposite the interior end of the inner segment (90), the exterior end of the inner segment (90), can join or connect to an interior end of the outer segment (96).

The outer segment (96) can have an interior end that joins or connects to the inner segment (90) and an opposite end, the exterior end, that joins or connects to the inner surface of the handling wall (64). Each segment can have a top end (the end nearest the upper handling member rim (66)) and a bottom end (the end nearest the lower handling member rim (70) or the cap rim (40)). The top end of the inner segment (90) can be located at the same elevation or height as the top wall (22), or proximate to the top wall (22). The bottom end of the inner segment (90) can be located at the same elevation as the cap rim (40) or proximate to the cap rim (40). The top end of the outer segment (96) can join the upper handling member rim (66) (and can have the same elevation or height as the upper handling member rim (66)). The bottom end of the outer segment (96) can be located at the same elevation or height as the cap rim (40). The outer segment (96) can include a wall-like surface that extends between the inner segment (90) and the inner surface (64) of the handling wall (60) in one plane, and extends between the cap rim (40) to the lower handling member rim (70).

Figure 3A:
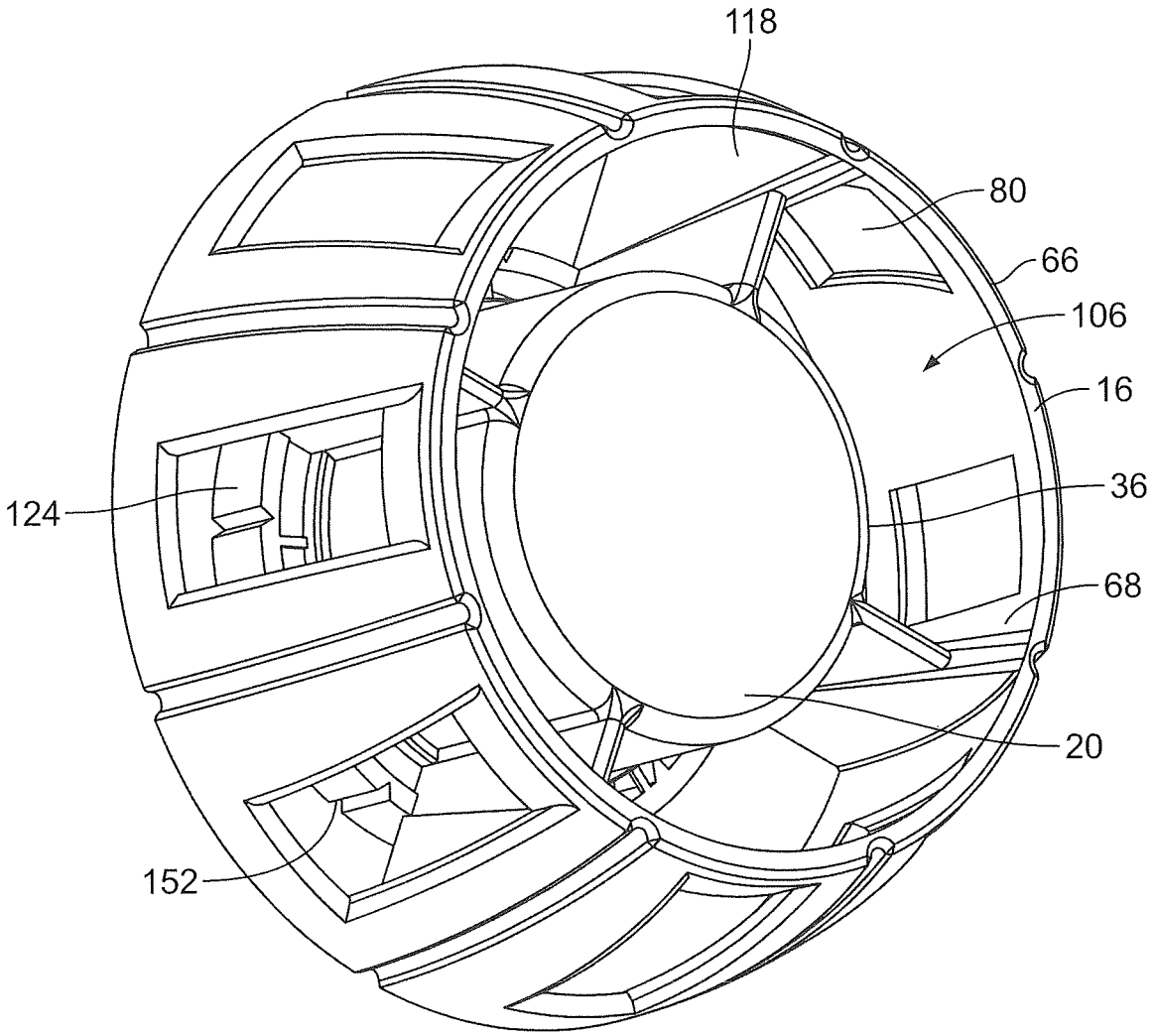
FIGS. 3A-3D shows an embodiment of a choke-resistant closure having an intact tamper-resistant band.
Figure 3B:
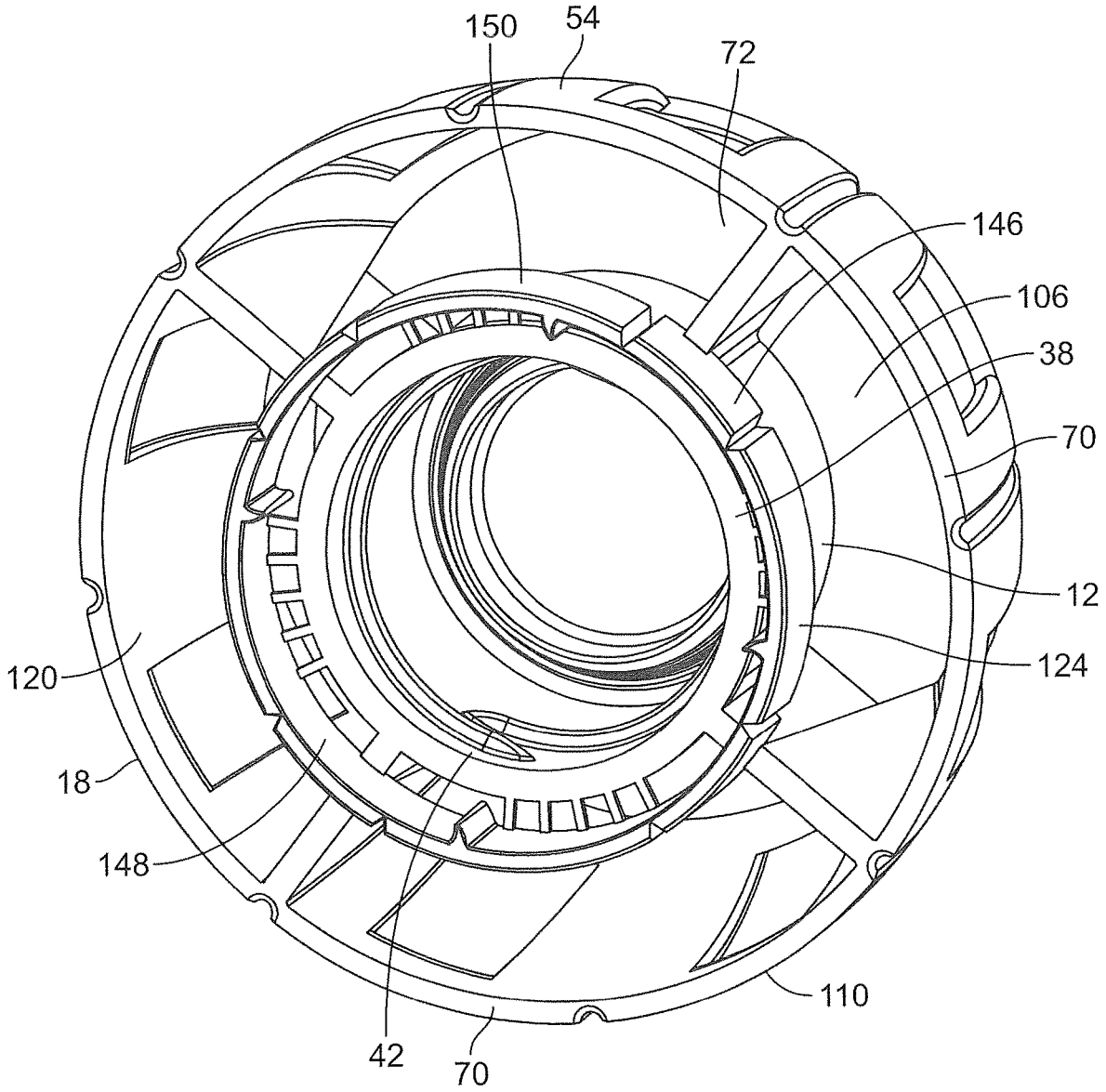
Figure 3C:
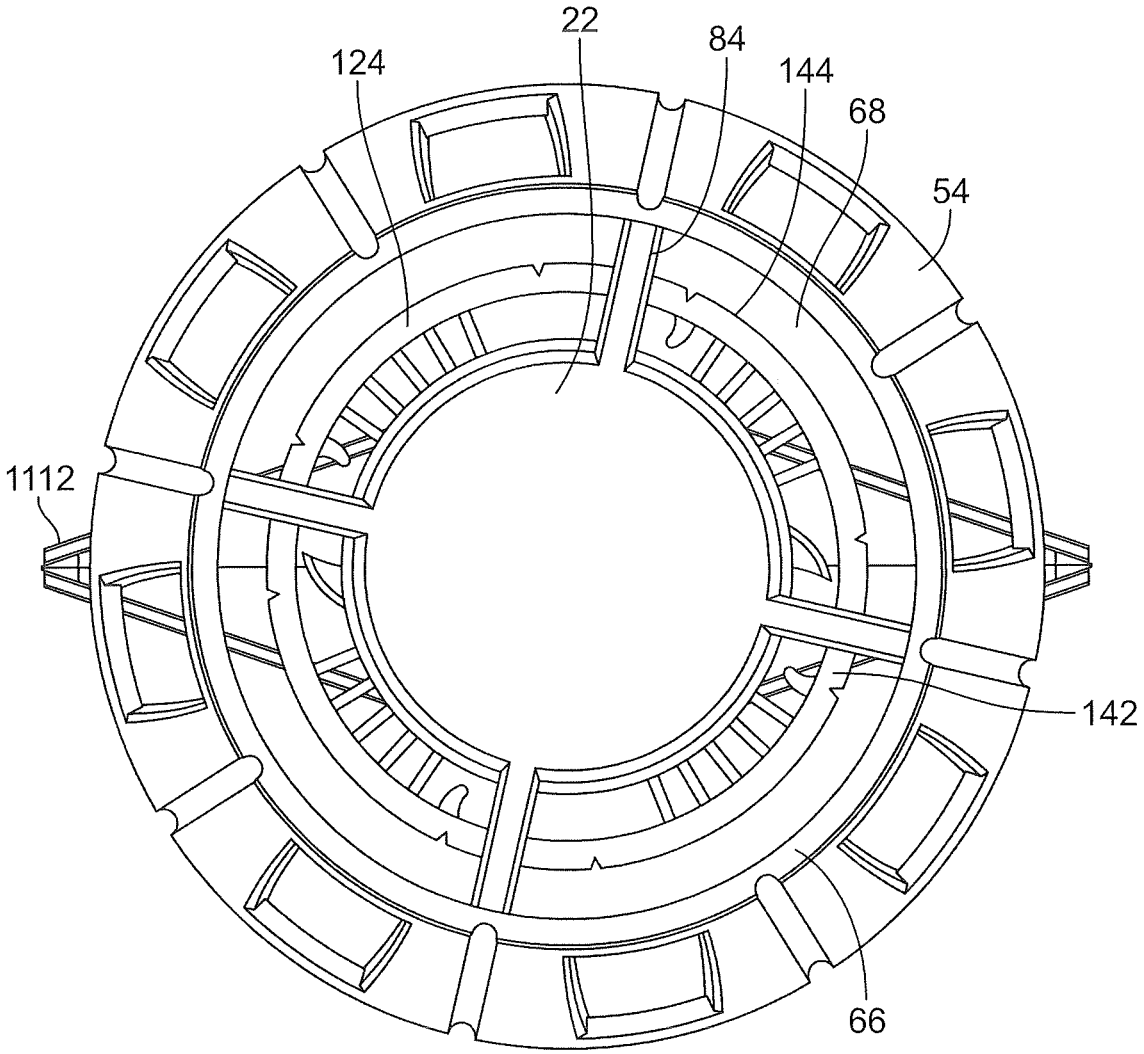
Figure 3D:
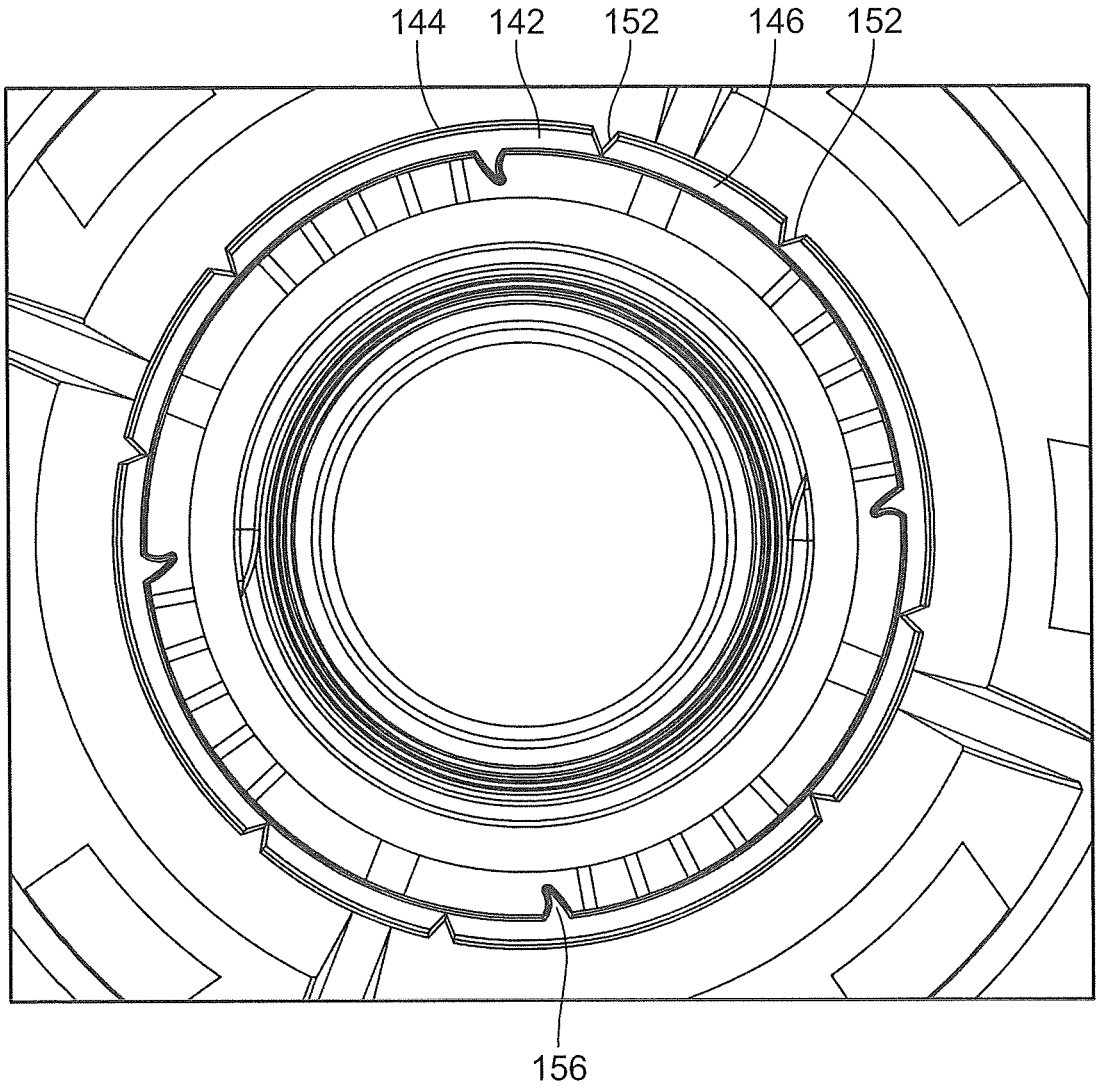

As shown in FIGS. 1C and 3B, the inner segment (90) can adopt a rectangular profile, while the outer segment (96) can adopt a triangular shape. Together, each paired of joined or connected inner (90) and outer (96) segments can define a septum (84), which can act as a wall or partition that divides the space between the peripheral wall (34) and the handling wall (60) into vertically-oriented ventilation pathways (222, 224,226) that run parallel between the top and bottom ends of the closure (10). It is to be noted that the inner (90) and outer (96) segments can adopt a variety of polygonal and non-polygonal shapes and profiles; also, they can connect directly to each other or indirectly to each other with other structures or spaces between them.

While the septa (84) can generally divide the cavity (106) into a group of smaller cavities (preferably of similar sizes, shapes, and volumes), it is preferred that the septa (84) not extend all the way up to the level of the upper handling member rim (66) and that it not extend all the way down to the level of. In some embodiments, a tamper-evident band (124) can occupy the lowermost portion (120) of the cavity, but its presence preferably does not impede or block airflow in the lowermost portion (120) of the cavity. It is preferred that air be able to flow freely through the uppermost (118) and lowermost (120) portions of the cavity, that these areas define spaces through which air can flow i the lower handling member rim (70). It is preferred that there is an absence of obstructions in an uppermost portion (118) of the cavity and/or a lowermost portion (120) of the cavity n a direct path or line.

The septa (84) can be similarly-sized and similarly-shaped, and where there are, for example, four septa (84) as shown in FIGS. 2A-2D, the septa (84) can divide the cavity into four primary vertical ventilation sub-passages (224).

The handling wall (60) can define a structure that is generally ring-like or annular, particularly when viewed from above or below. The diameter (or perimeter) of the upper handling member rim (66) can have a length greater than that of the lower handling member rim (70) (or vice-versa). Thus, the closure (10) can be provided with a shape like the frustum of a cone or pyramid, like a cone or pyramid whose tip has been cut off parallel to its base. The closure (10) can be provided with a shape like a hemisphere whose tip end has been cut off parallel to its base. The handling wall (60) can flare outward from the upper handling member rim (66) and downward toward the lower handling member rim (70). When viewed in profile, the handling wall (54) can define an outward-reaching slope or an outward-reaching curve.

The handling wall (54) can have one or more openings (80) that extend through the handling wall (60), each opening set within a portion of the handling wall (60), and each opening bounded on all sides by the handling wall (60). These openings (80) can provide pathways (220) for the passage of air through the handling wall (60), from the environment outside of the closure (10) into the cavity (106) or interior portion (12) of the closure (10). It is preferred that the openings (80) be spaced apart at regular intervals, and it is preferred that the openings (80) be of the same size and shape. In particularly preferred embodiments, the handling wall (60) contains a plurality of openings (80) in each portion of the handling wall (60) between a pair of neighboring septa (84).

The openings (80) can have a longitudinal axis that is parallel to a longitudinal axis of the cap member (20), handling member (54), and/or closure (10). It is preferred that the vertical length (or length along the longitudinal axis) of each opening (80) be greater than one half of the distance between the upper (66) and lower (70) handling member rims.

Where the handling wall (60) curves downward and outward from the upper handling member rim (66) toward the lower handling member rim (70), each opening (80) can define a secondary vertical ventilation passage (226), where each secondary vertical ventilation passage (226) defines an unobstructed pathway for air flow from the outer surface (62) of the handling member, through the handling member (54), and into the cavity (106) between the cap (20) and handling members (54), when viewed from above or below as shown in FIGS. 2C-2D. Each secondary vertical ventilation passage (226) can be bounded on a first end by an opening (80) in the handling wall (60) of the handling member (54), and bounded on a second end by the lower handling member rim (70). Each secondary vertical ventilation passage (226) can extend in a straight or direct line through the interior portion (e.g., the cavity (106)) of the closure (10).

As shown in FIGS. 2A-2D, the outer surface (62) of the handling wall (60) can include a depression or groove (74) running from the upper handling member rim (66) to the lower handling member rim (70), each groove (74) preferably running parallel to a longitudinal axis of the handling member (54) or the closure (10). Preferably spaced apart at regular or equal intervals, the negative space provided by these grooves (74) provides an embodiment of a closure (10) requiring less materials to make, compared to an otherwise identical version of the closure (10) lacking those grooves (74).

It is also believed that these grooves (74) can also allow the closure (10) to flex when pressure is applied to the closure (10). Thus, the closure (10) can resist crushing pressures. By maintaining its structure and shape, some (or preferably all) of the various ventilation passages (220) can remain intact while the closure (10) is retrieved from the airway of an individual. It also believed that the longitudinal orientation of the grooves (74), especially when placed between neighboring (80) openings, can encourage the closure (10) to flex in such a way as to keep the various vertical ventilation passages (22,224,226) unobstructed and conducive to allowing the movement of air.

As shown in FIGS. 2B and 3-4, the closure (10) can comprise a tamper-evident band (124). The tamper-evident band (124) can define a band or a ringlike structure that surrounds or encircles the cap rim (40), having an inner face (142) and an outer face (144). The outer perimeter of the tamper-evident band (124) can be radially disposed between an outer perimeter (48) of the peripheral wall and an inner perimeter (64) of the handling member. The outer face (48) can define a continuous surface without gaps or holes.

The tamper-evident band (124) can be disposed between the peripheral wall (34) and the lower handling member rim (70), with an upper portion of the tamper-evident band (126) paralleling the lower handling member rim (70) and a portion of the peripheral wall (34) closest to the lower handling member rim (70). The lower portion of the tamper-evident band (128) can extend downward and outward (away from the top wall (22)) past the cap rim (40) and past the lower handling member rim (70).

Similar to the handling wall (60), the tamper-evident band (124) can directly or indirectly connect to the cap member (20) via one or more connecting structures. The connectors can join the inner face (142) of the tamper-evident band to the outer surface (48) of the peripheral wall (34). As shown in FIG. 1C, the connectors can join the inner face (148) of the tamper-evident band (124) to cap rim (40) of the peripheral wall (34), while the outer face (150) opposes or faces the handling wall (60). These connecting elements can include a plurality of axially-extending, spaced-apart, finger-shaped connectors meant to retain their attachment to the cap member (20) when the closure (10) is disconnected from the fitment (1112) or container.

As shown in FIGS. 2C-2D, 3C-3D, and 4A-4C, each connecting element can provide a generally planar, finger-like structure having a width that is thinner than that of a septum (84) or the tamper-evident band (124) (e.g., when viewed from above or below). Multiple connecting elements can be clustered together, preferably on portions of the tamper-evident ring that are removed from the septa (84). It is preferred that the connecting elements be oriented in a radial fashion, as they extend between the peripheral wall (34) and the handling wall (60).

The tamper-evident band (124) can be joined or connected to one or some or all of the septa (84). It is preferred that the septa (84) contact an upper surface (126) of the tamper-evident band (124) (the surface closest to the upper handling member rim (66), rather than a lower surface (128) of the tamper-evident band (124) (the surface furthest from the upper handling member rim (66)). As shown in FIGS. 1B-1C and 2B, a lower surface or bottom edge (88) of a septum and the top edge (126) of the tamper-evident band (124) can overlap each other. This can reinforce the stability of the septa (84) and the tamper-evident band (124).

When viewed from above or below, a central portion of the closure (10) can be occupied by the cap member (20), which is surrounded or encircled by the tamper-evident band (124), which is in turn surrounded or encircled by the handling wall (60). These elements can define concentric rings or shapes around each other, preferably not touching each other directly.

Figure 4A:
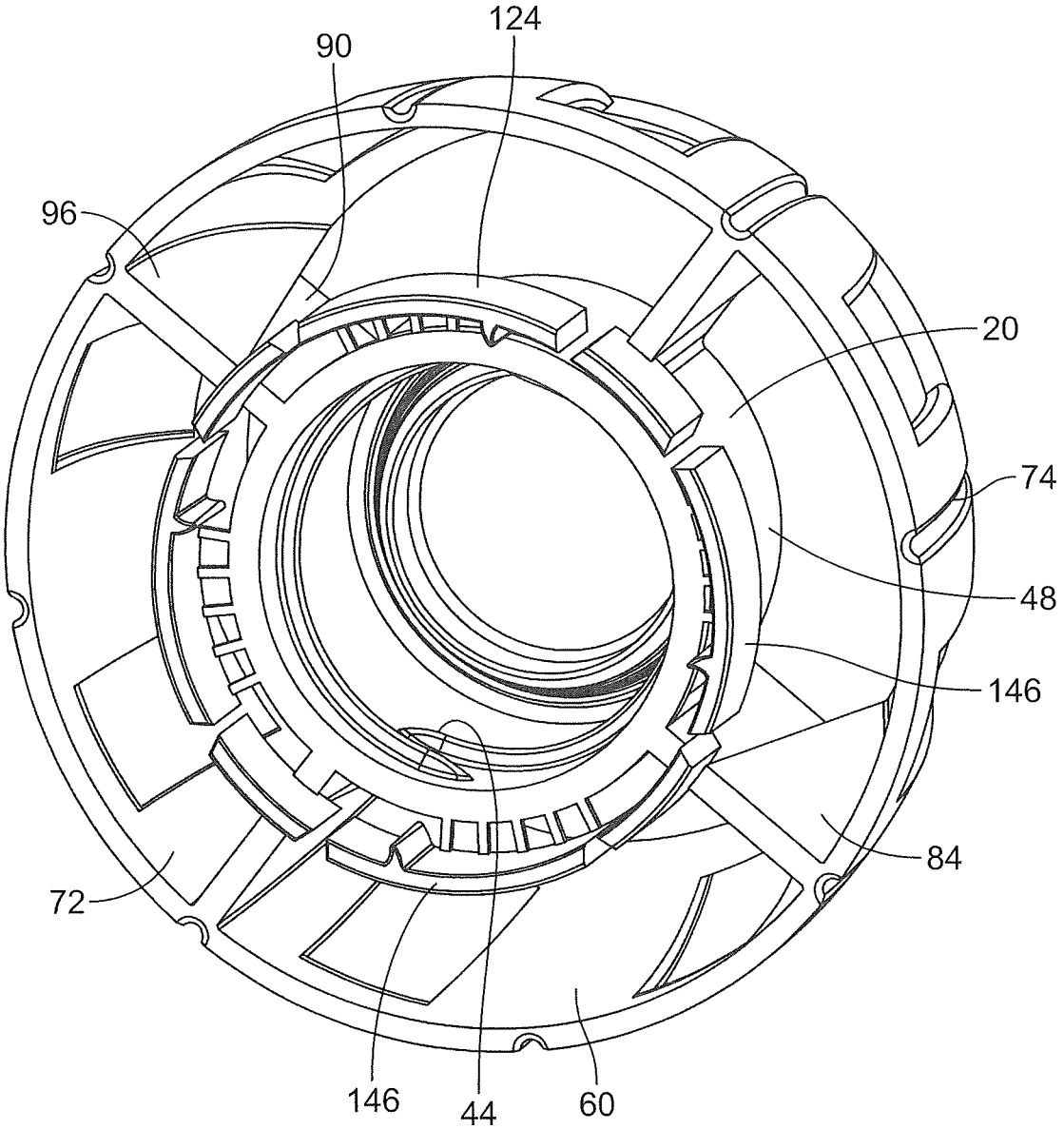
FIGS. 4A-4C shows an embodiment of a choke-resistant closure having an intact tamper-resistant band after the closure has been unsealed from a fitment or container and after the tamper-resistant band has been separated into segments attached to a cap member or to a partition connecting the cap member to a handling member.
Figure 4B:
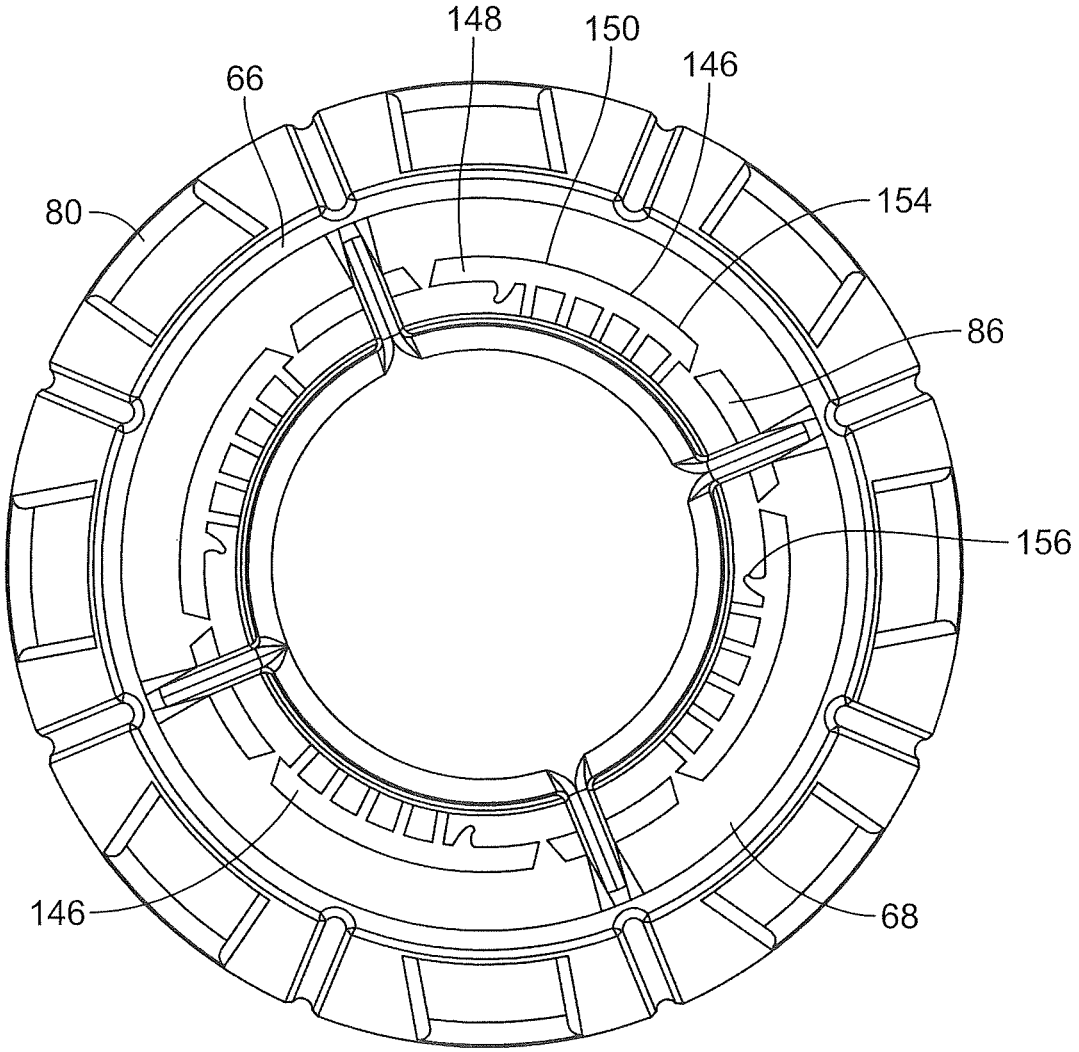
Figure 4C:
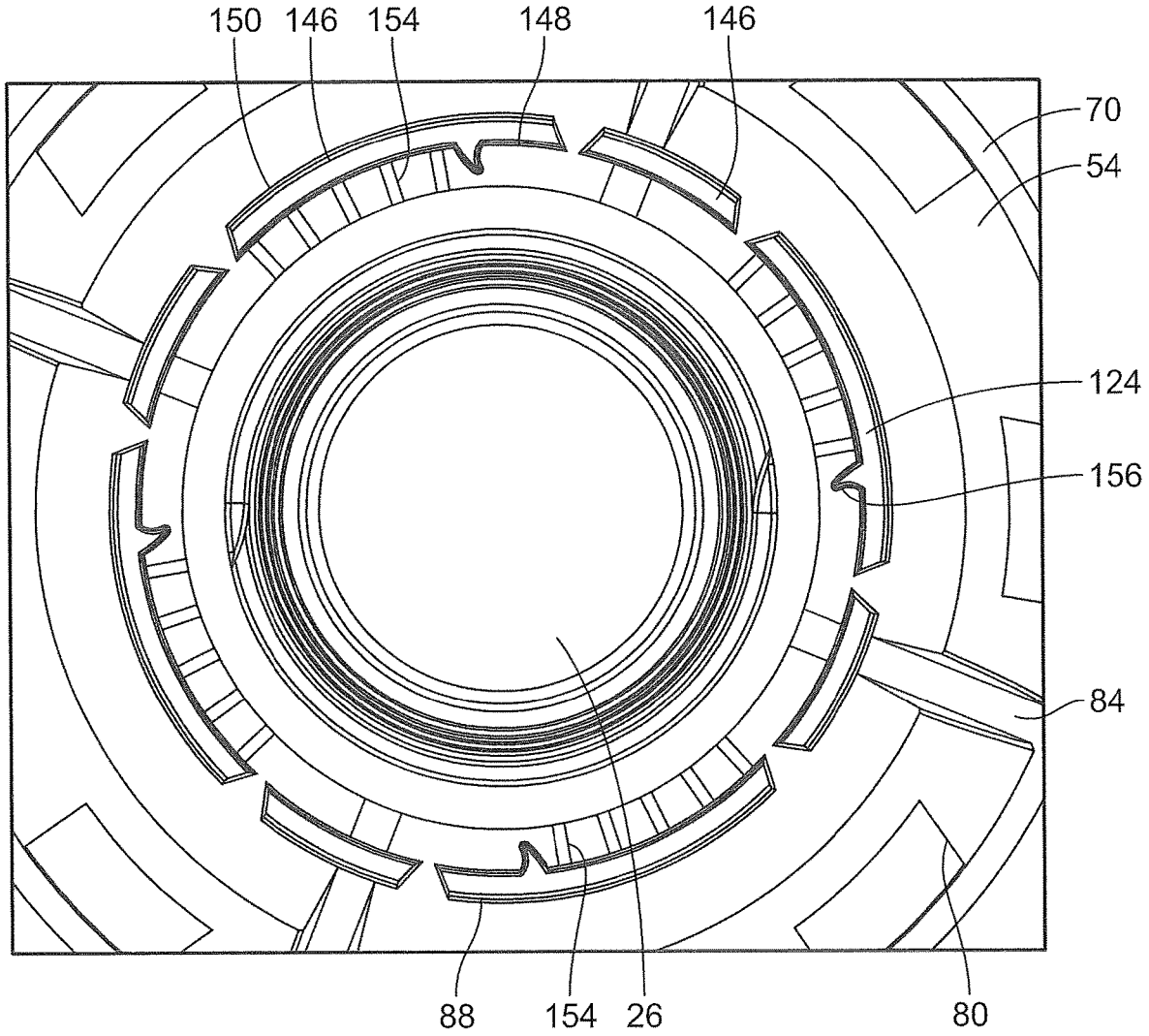
Figure 5A:
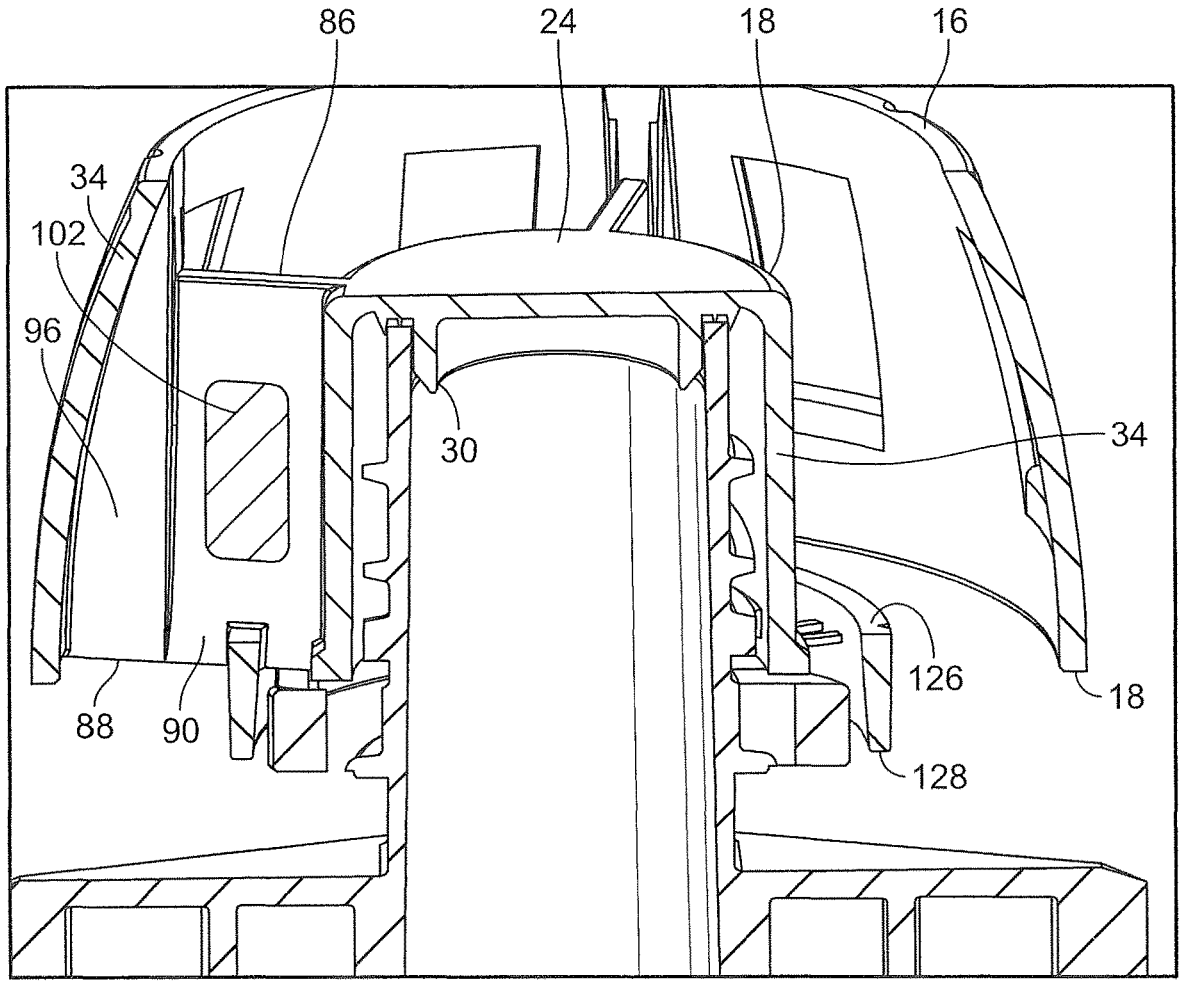
FIGS. 5A-5B shows views of an embodiment of a choke-resistant closure mounted onto a coupling member of a fitment that connects the closure to the container.
Figure 5B:
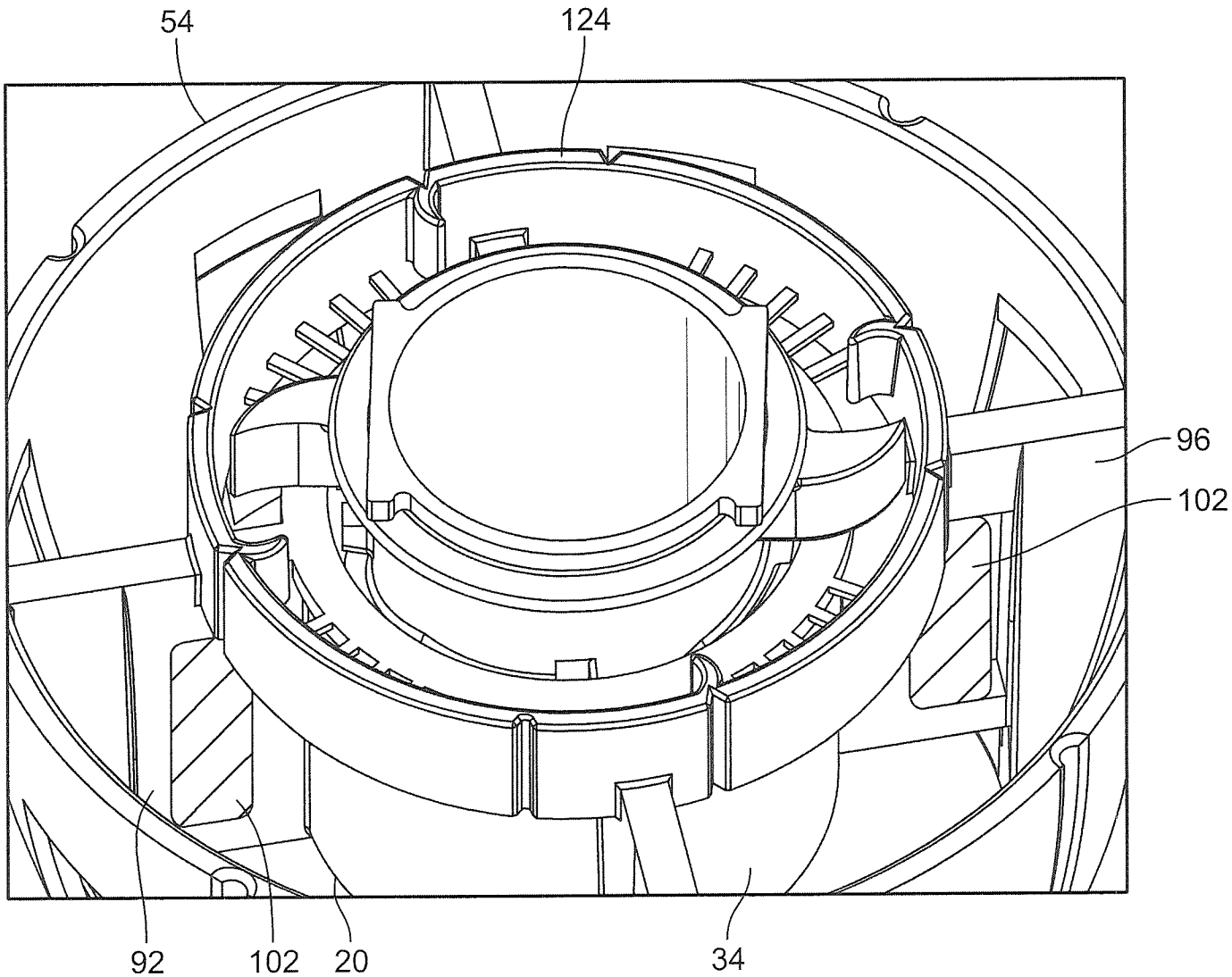

Each tamper-evident ring can include one or more indentations (152) that extend from the inner (142) or outer (144) surface of the tamper-evident ring almost to the inner surface (142) of the tamper-evident ring. It is preferred that these indentations (152) traverse more than half of the thickness of the tamper-evident ting. As shown in FIGS. 3A-3D, these indentations (152) can be located on the outer surface (144) of the tamper-evident ring, and extend from the upper surface (126) to the lower surface (128) of the tamper-evident ring. The indentations (152) can have a U-shaped or V-shaped profile, creating locations on the tamper-evident ring that will tear when sufficient pressure is applied to the tamper-evident ring. When the tamper-evident ring is subjected to these forces, such as a rotational movement applied to unscrew a cap from a container, the tamper-evident band can tear or break at these thinner sites in the tamper-evident band (124) (compared to the thickness of a portion of the tamper-evident band (124) not containing an indentation (152)), thus separating the tamper-evident band (124) into multiple individual band segments (146), as shown in FIGS. 4A-4C.

When taken together in an intact tamper-evident band (124), the band segments (146) can encompass the full circumference or perimeter of the tamper-evident band (124). That is, the band segments (146) can join together to make up the tamper-evident band (124). As desired, the tamper-evident band (124) can have as few as a single band segment (146), or as many band segments (146) as desired, for example 2 band segments, 3 band segments, 4 band segments, 5 band segments, 6 band segments, or more. Each band segment (146) has a length, and is associated on a first, inner surface (46) connected to the peripheral wall (34), and is associated on a second, opposite, outer surface (48) facing the interior surface (64) of the handling wall (60).

For each portion of the tamper-evident band (124) located between two neighboring septa (84), that portion can contain at least one indentation (152) located between a septa (84) and a connecting element (154). It is preferred that portion include at least one indentation (154) between every neighboring septa (84) and connecting element (154).

The tamper-evident band (124) can also include, preferably on its inner face (142), one or more engagement elements (156), the engagement elements (156) for engaging corresponding structures on a fitment (1112) or container when the closure 10) (and the tamper-evident band (124)) is rotated around the fitment (1112) or container to unseal the closure (10) from the fitment (1112) or container. Each engagement element (156) can include a protrusion extending outward from a face of the tamper-evident band (124), preferably toward another structure. As shown in FIGS. 2B-2D, an engagement element (156) can define a curving extension joined to the inner face (142) of the tamper-evident band (124), extending toward the peripheral wall (34), but not contacting the peripheral wall (34). In some other embodiments, an engagement element (156) can define a protruding or projecting structure extending from the outer surface (144) of the tamper-evident band (124), extending toward the handling wall (60). The engagement element (156) can define a structure that communicates with the upper (126) or lower edges (128) of the taper-evident band (124), or defines a structure extending from the upper edge (126) to the lower edge (128). Engagement elements (156) can take a variety of shapes and sizes, for example, a bead, a hook, a curving finger, a shelf, and the like.

The tamper-evident band (124) can include at least one engagement element (156) that results in the breakage of the band into band segments (146), when the closure (10) is disconnected from such receptive portion of such fitment (1112) or such container, thus to indicate that the fitment (1112) or the container has been unsealed, opened, or breached.

For example, the closure (10) can be disconnected from the fitment (1112) by rotating or unscrewing the closure (10). As the closure (10) is moved in this manner, the engagement elements (156) on the tamper-evident band (124) can engage corresponding receiving elements on the coupling or receptive portion of the fitment (1112) such that the tamper-evident band (124) is prevented from rotating with the closure (10) beyond the point where the engagement elements (156) engage with the receiving members. The resistance between the engagement elements (156) and the receiving elements on the coupling is stronger than the indentations (152) that score the surface of the tamper-evident band (124). Accordingly, as the closure (10) is rotated, one or more of the indentations (152) tears or breaks, and the tamper-evident band (124) can separate into several band segments (146). These band segments (146) can remain attached to the peripheral wall (34) via the connection provided by the connecting elements (154) and/or the septa (84).

The disruption of the physical integrity of the tamper-evident band (124) and the appearance of the band segments (146) can provide a clear visual indicator that the tamper-evident band (124) has been broken, that the seal or connection between closure (10) and fitment (1112) has been breached, and that the integrity of the corresponding container contents has been compromised. FIGS. 4A-4C show that a tamper-evident band (124) that has been broken into band segments (146) can remain associated with the cap member (20) by the connections between the band segments (146) and the cap members (20).

Where there is a plurality of engagement elements (156), it is preferred that they are located on the tamper-evident band (124) so as not to interfere with the tearing of the tamper-evident band (124) into band segments (146). That is, it is preferred that the engagement elements (156) be located so as not to interfere with the tearing of the indentations (152) on the tamper-evident band (124), when the opening or unsealing of the closure (10) engages the tamper-evident band feature. It is preferred that each septa (84) have an engagement element (156) located proximate to it.

As shown in FIGS. 4A-4C, after the tamper-evident band (124) has been separated into one or more band segments (146), the separated band segments (146) can remain connected to the closure (10) via the septa (84), the connecting elements (154), or both structures. Thus, after the tamper-evident band (124) has been deployed, it can remain connected to the closure (10). This way, the tamper-evident band (124) can be prevented from falling into the container to which it is attached, or from detaching from the closure (10) to provide its own choking hazard to an individual.

Features of Embodiments of the Closure

Figure 6A:
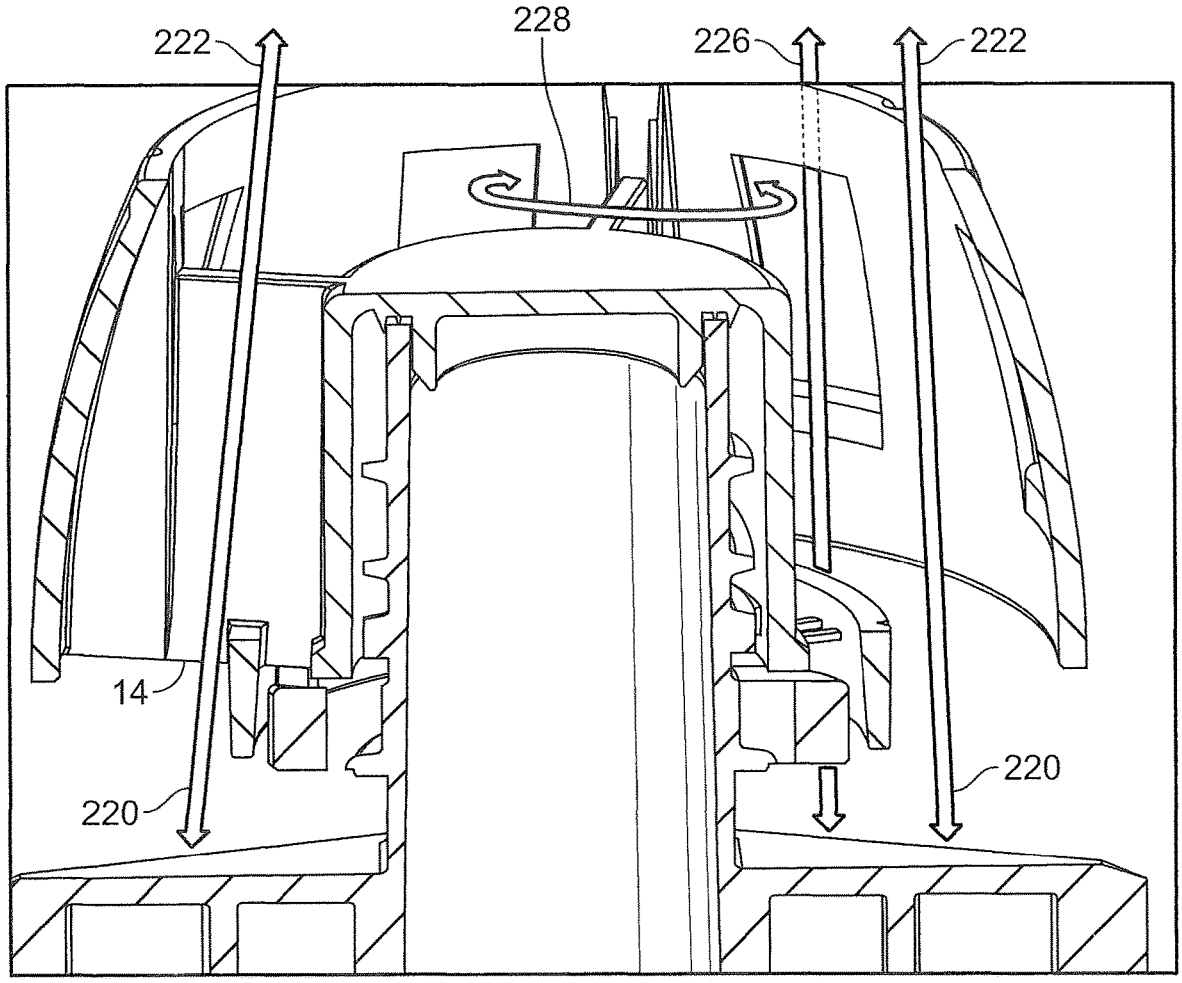
FIGS. 6A-6C show structures that facilitate air flow through an exemplary closure and indicate primary vertical ventilation passages, secondary ventilation passages, and horizontal ventilation passages that facilitate air flow through the interior of the closure.
Figure 6B:
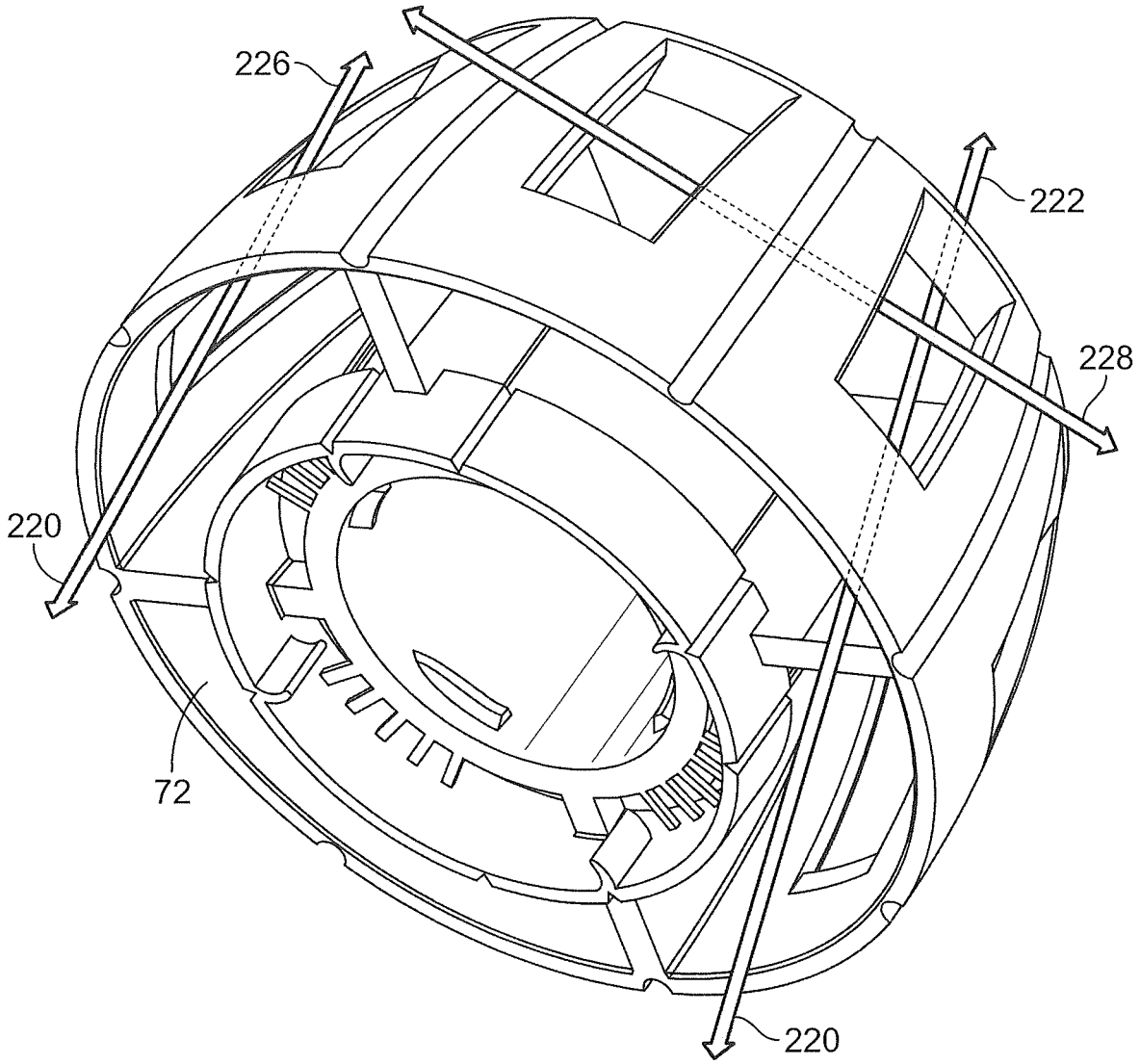
Figure 6C:
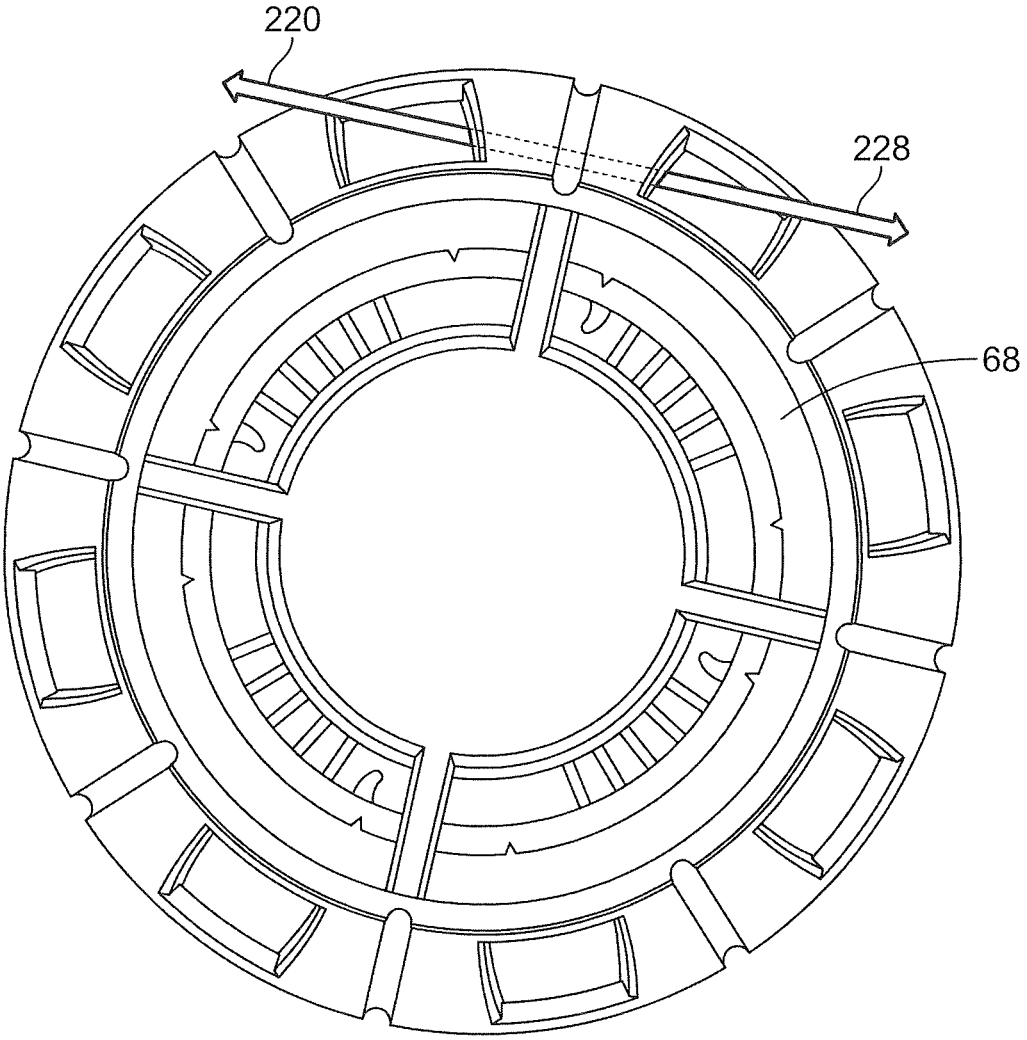
Figure 7A:
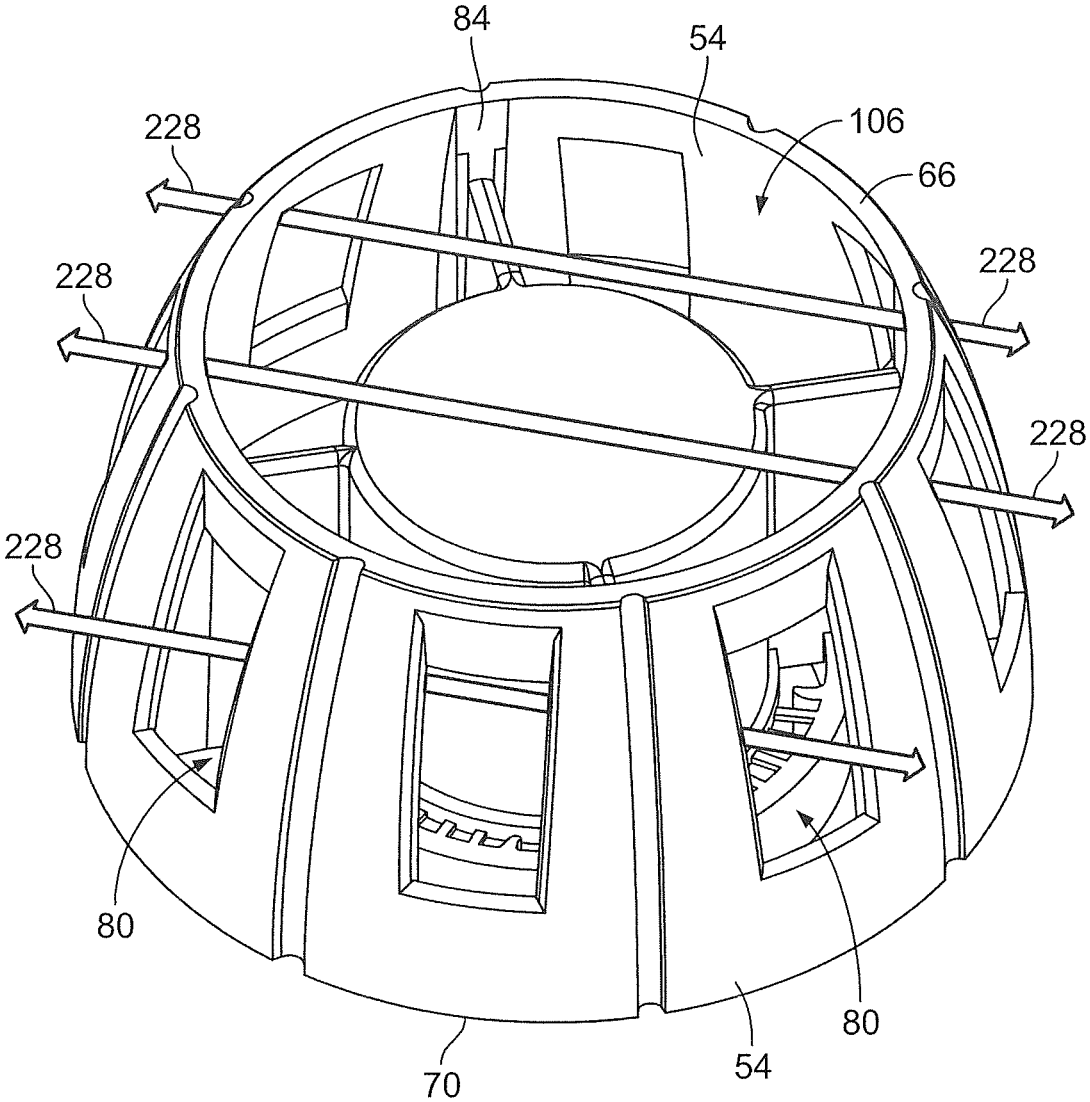
FIGS. 7A-7C show perspective views (FIGS. 7A, 7C) and a top view of horizontal ventilation passages that allow air to pass through an interior cavity within a closure by allowing air to pass through a first aperture or opening in the side surface of the closure, into a cavity inside the closure, and out of the cavity via a second aperture or opening in the side surface of the closure.
Figure 7B:
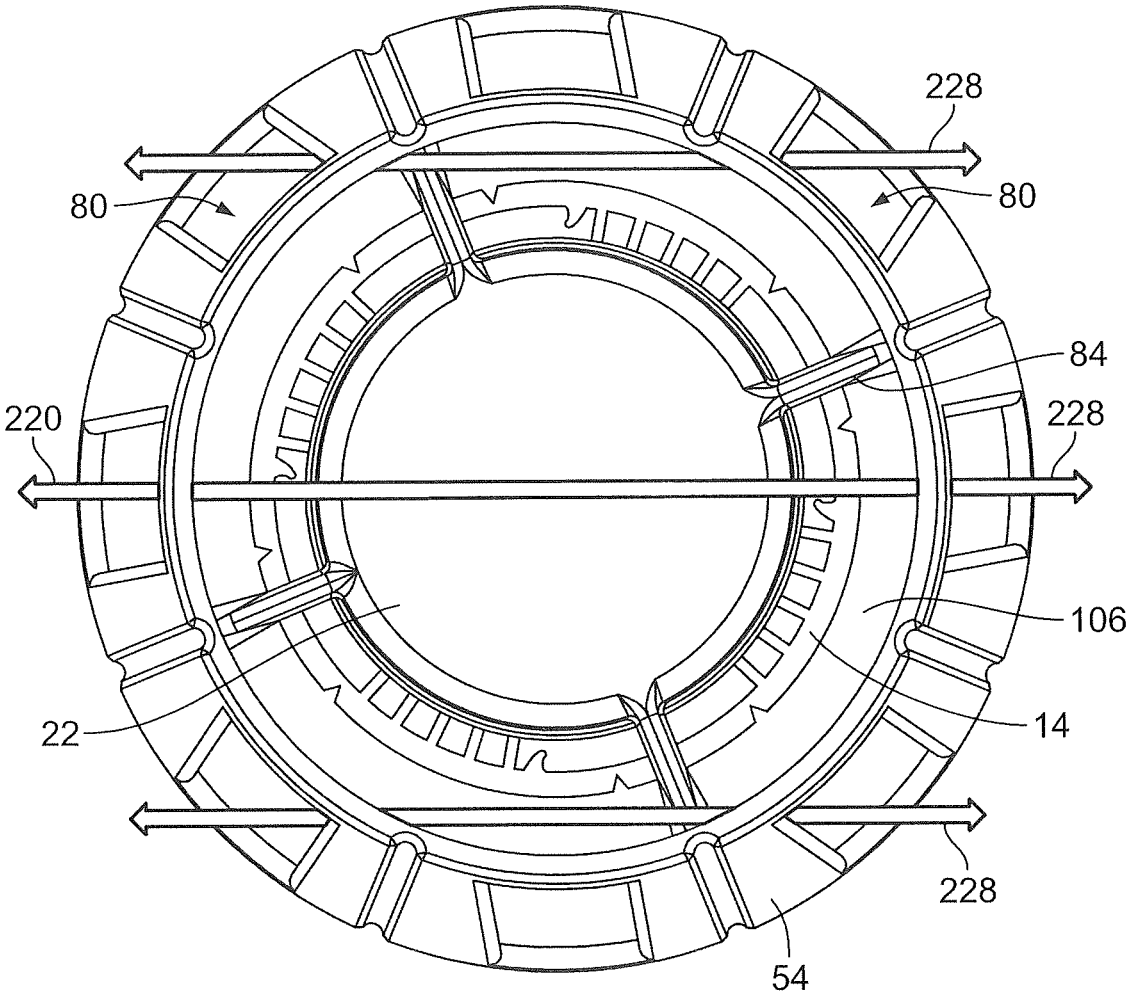
Figure 7C:
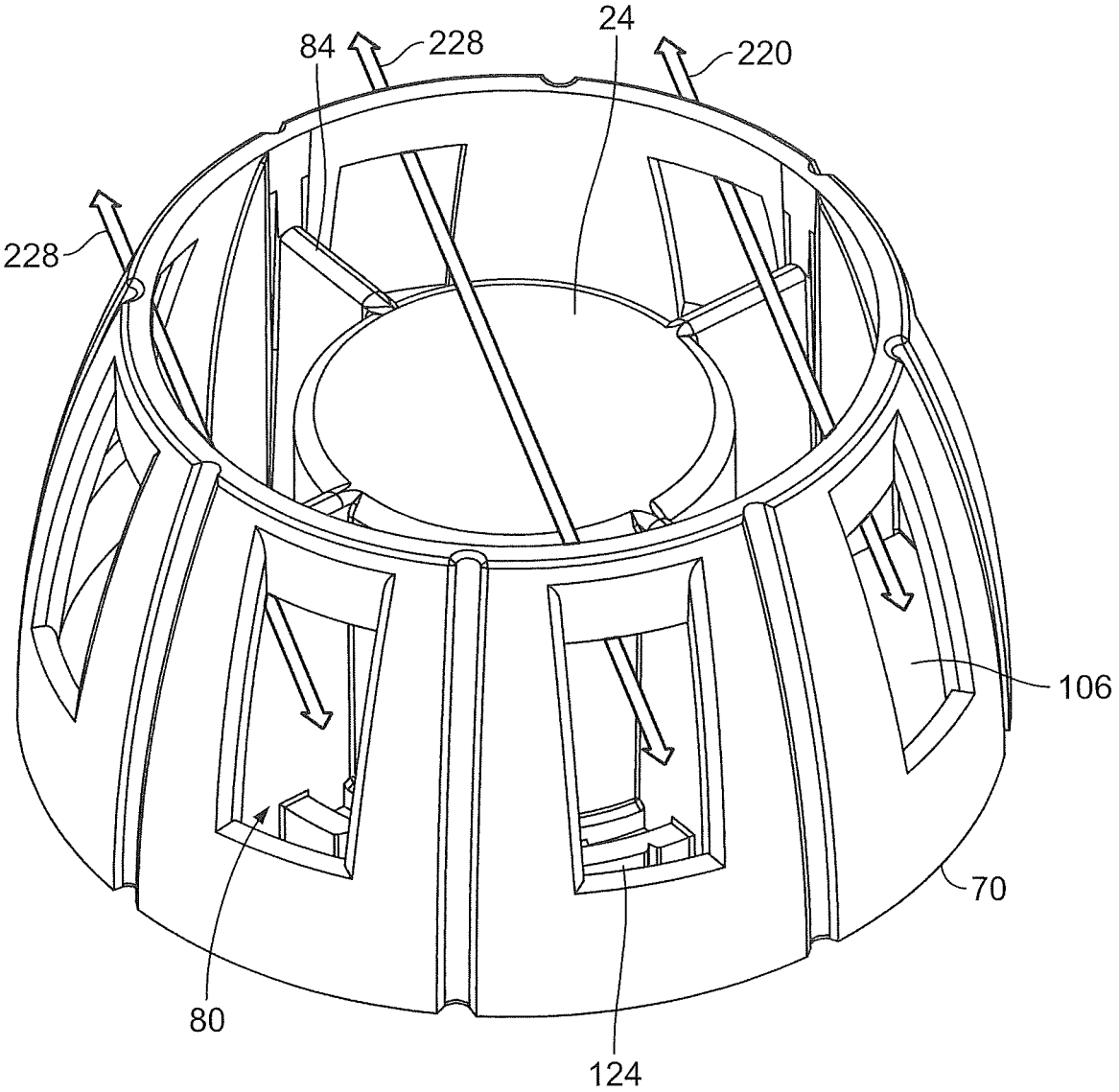
Figure 8A:
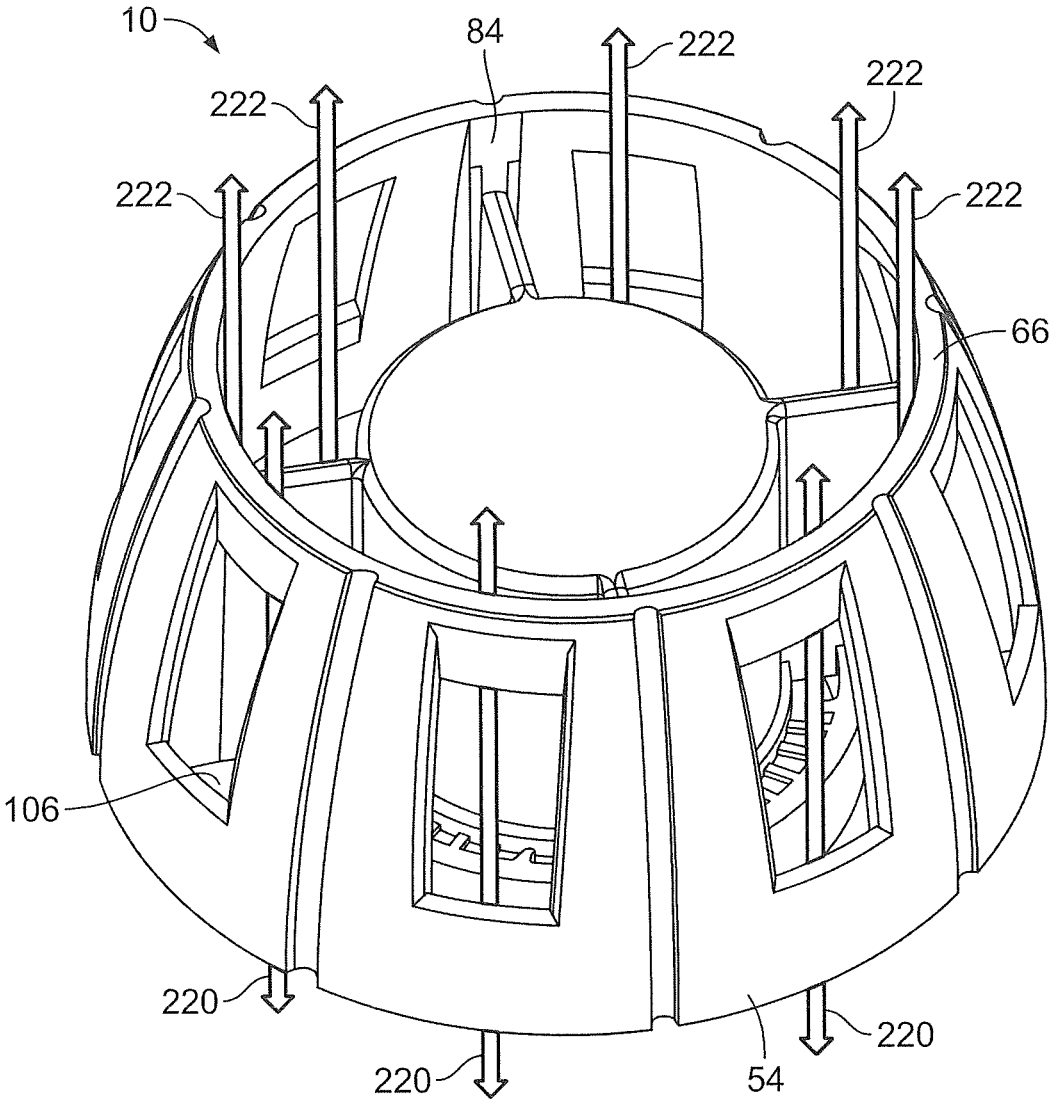
FIGS. 8A-8D show perspective views of primary vertical ventilation passages that allow air to pass through an interior cavity within a closure by allowing air to pass through a first aperture or opening in the side surface of the closure, into a cavity inside the closure, and out of the cavity via a second aperture or opening in the side surface of the closure.
Figure 8B:
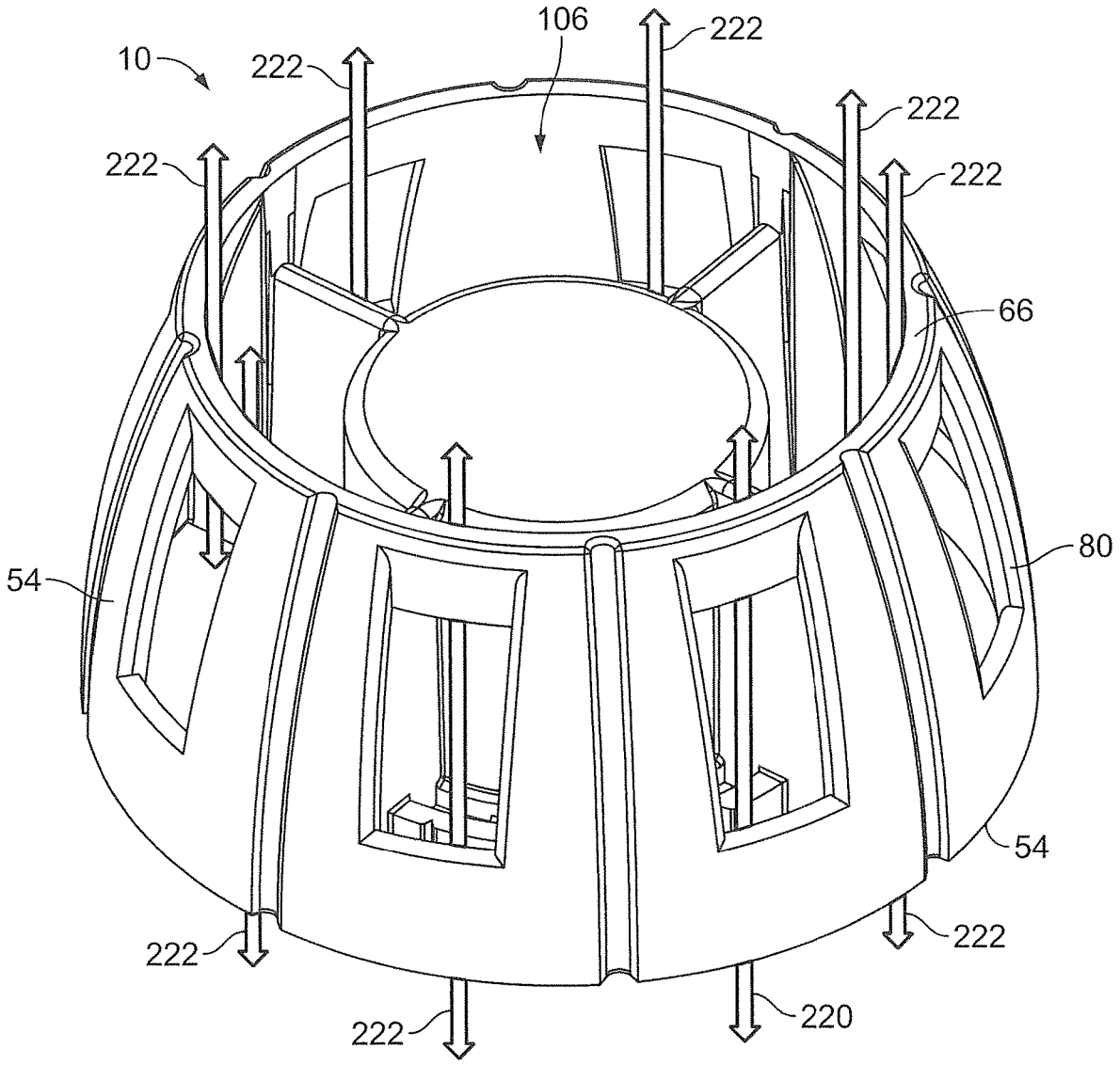
Figure 8C:
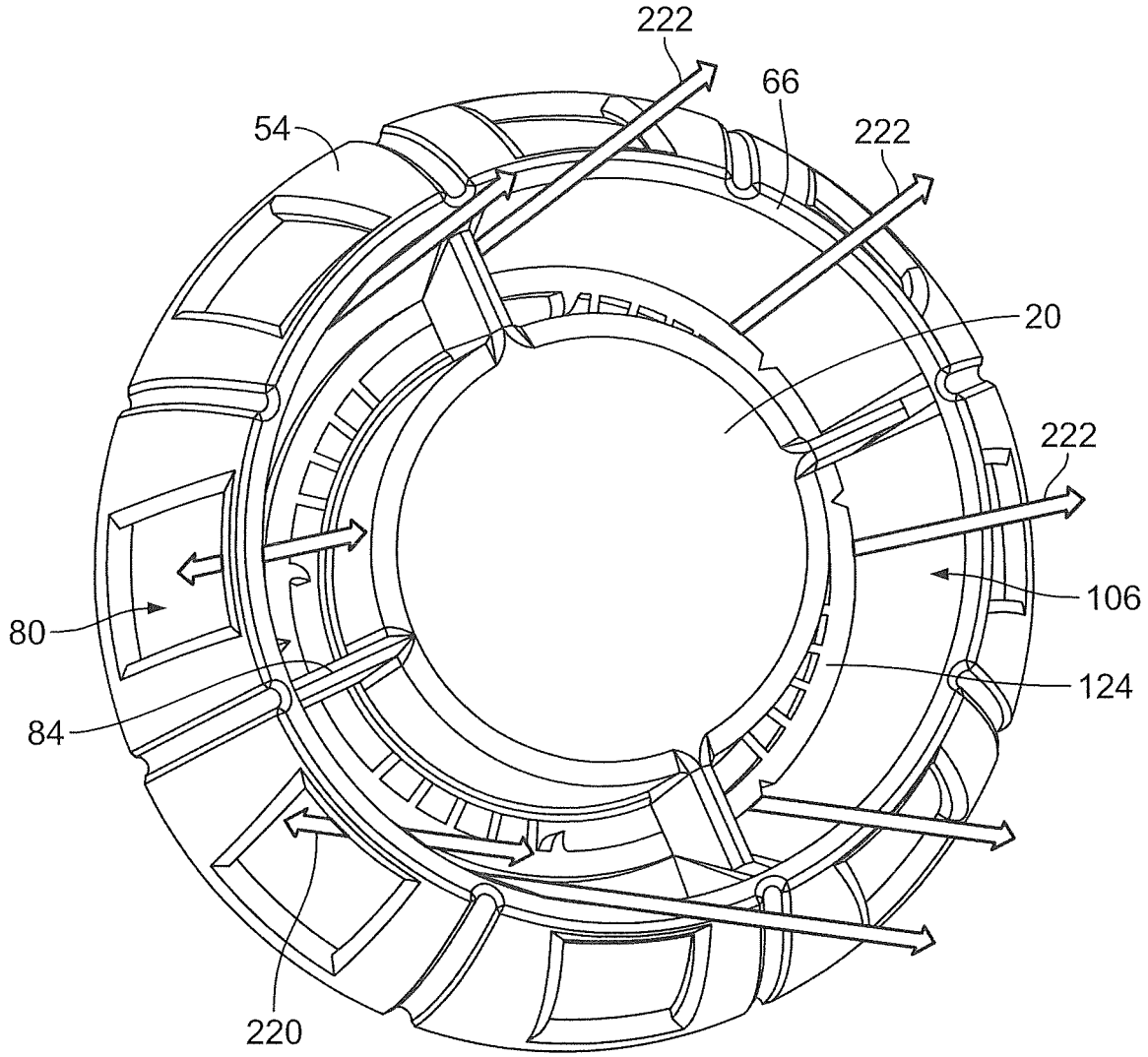
Figure 8D:
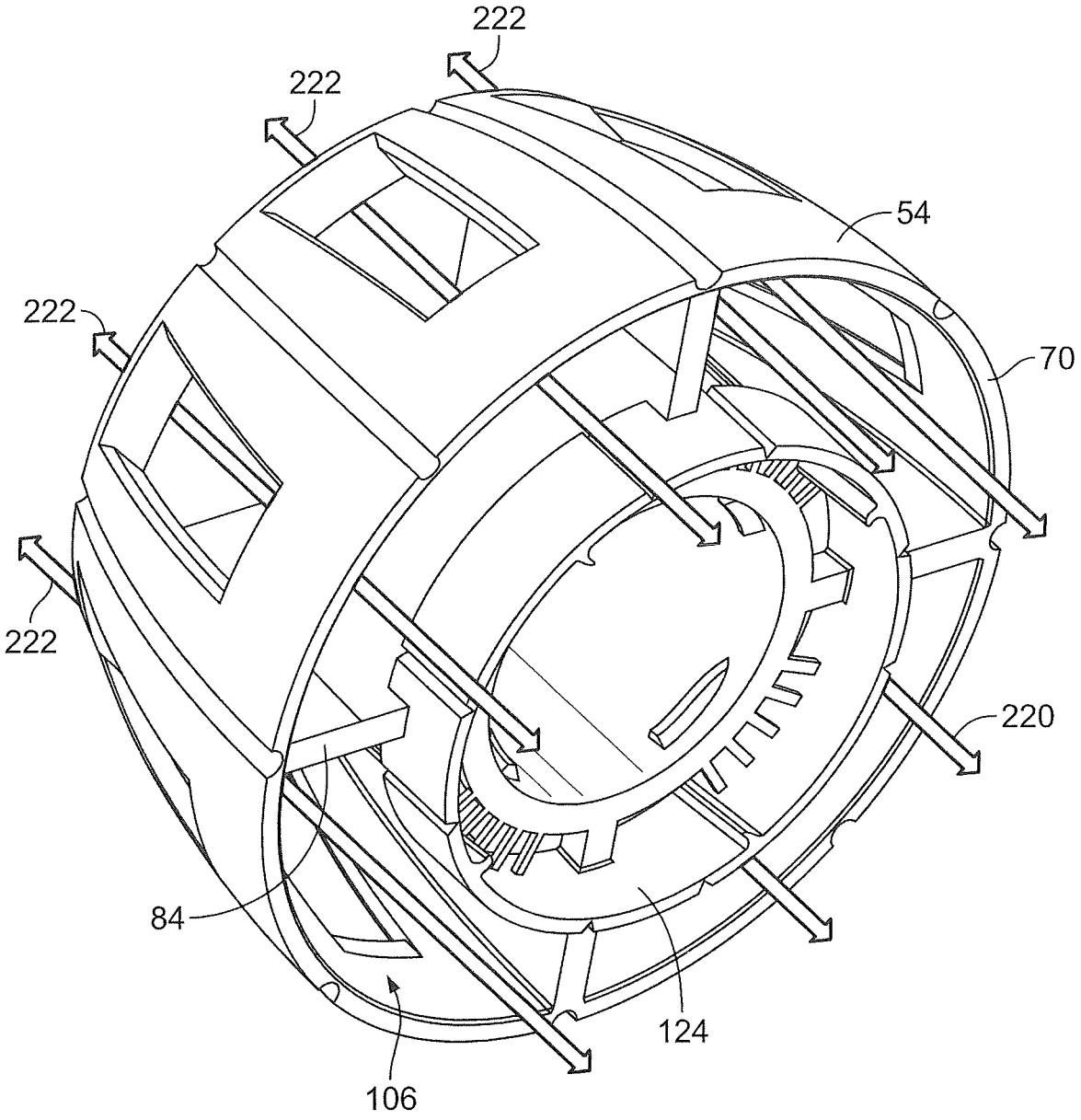

Closures are routinely used as devices for closing or sealing a fitment or container; the risk that they pose as a choking hazard is well-known. As shown in FIGS. 6A-6B, the closures (10) described herein are designed to provide a multiplicity of ventilation passages (220) in straight or direct vertical (or longitudinal), straight or direct horizontal (or lateral), and non-linear pathways. The number, placement, and design of these ventilation passages (220) provide multiple, redundant vertical and horizontal passages for the flow of air when the closure is lodged in an individual's airway, in the hopes that at least one of these pathways will be main unobstructed and support the continued flow of air to the individual, thus reducing the risk of choking in an individual who has swallowed the closure (10).

Closure Structures Supporting Direct Vertical Airflow Through the Device

If the closure (10) is lodged right-side-up or upside-down, it is expected that the individual's airway can block some or all of the openings (80) in the handling wall (60) of the handling member (54). Thus, the side or lateral surfaces of the closure (10) can contact (and be obstructed by) an individual's airway. In such situations, where the top (16) and bottom (18) of the closure (10) are unobstructed (or a portion of those surfaces are unobstructed), air can flow through at least one of a primary or first vertical ventilation passage (222) (between the cap member (20) and the handling member (54)); if a portion of the handling wall (60) is unobstructed, one or more secondary vertical ventilation passages (226) (through unobstructed openings in the handling wall (60) and through the lower handling member rim (70) can provide air flow through the closure (10) in a vertical direction. In these configurations, vertical ventilation passages can support airflow to the individual through the interior of the closure (10), even in some cases where the top (16) and/or (18) bottom of the closure is also partially unobstructed.

As shown for example in FIGS. 8A-8D, when the closure (10) is oriented in an upright position, the primary vertical ventilation passage (222) (or a portion of it), can provide a passageway for conveying air through the interior portion of the closure (10); air can enter the top of the closure (10) through the upper handling member rim (66), travel through the interior space or cavity (106) within the closure (10), and exit the bottom of the closure (10) through the lower handling member rim (70). The air can flow in a linear, straight, direct vertical path from the top to the bottom of the closure (10). Similarly, when the closure (10) is oriented in an upside-down position, the primary vertical ventilation passage (222) (or a portion of it), can similarly provide a passageway for accommodating air flow through the interior portion of the closure (10); air can enter the bottom of the closure (10) through the lower handling member rim (70), travel through the interior space or cavity (106) within the closure (10), and exit the top of the closure (10) through the upper handling member rim. Here, too, the air can flow in a linear, straight, vertical path from the bottom to the top of the closure.

At least one secondary vertically-oriented ventilation passage (226) can be provided if the bottom of the closure (10) is unobstructed and at least one opening (80) is unobstructed. Here, air can flow in a linear, straight, vertical path through the closure (10), but instead of entering and exiting through the top (16) and bottom (18) ends of the closure (10), the air can flow in a linear, straight, vertical path through structures in the lateral or side portions of the closure (10). That is, the openings in the handling wall (60) can define pathways for air to enter through at least one unobstructed opening, travel through the interior space or cavity within the closure (10), and exit the bottom (18) of the closure through the lower handling member rim (70) (if the bottom surface of the device is at least partially unobstructed).

Where the lower handling member rim (70) has a larger diameter or circumference than the upper handling member rim (66), and the top surface of the device is at least partially unobstructed, the exact opposite does not hold true; that is the geometry of such embodiments of the closure (10) do not support vertical airflow into an opening (80), into the cavity (106), and out through the upper handling member rim (66). Instead, the closure (10) can support a non-linear pathway that allows air to exit through the upper handling member rim (66). For example, in the situation where the bottom surface of the device is blocked or obstructed, air can flow into an unobstructed opening in the handling wall (60) in a lateral or horizontal or transverse direction relative to a longitudinal axis of the closure (10), travel through the cavity (106), and exit through the upper handling member rim (66); however, this route or conduit will not be a linear and vertical path, but a circuitous pathway that curves or angles or changes direction.

In some embodiments, a vertically-oriented ventilation passage can define a ventilation passageway that is not strictly straight or linear, where the airflow is generally vertical in the sense that a passageway for airflow is provided through a vertical axis of the closure (10). For example, a primary vertical ventilation passage (222) can provide air flow into the top end (16) of the closure (10), through an interior portion (12) of the closure, and out the bottom end (18) of the closure (10), following a continuous or unbroken, but not necessarily straight or direct, path through the closure (10). The primary (222) and secondary (226) vertical ventilation passages can support air flow in a vertical direction, but following an indirect pathway through the closure (10).

Closure Structures Supporting Direct Horizontal or Lateral Airflow Through the Device Where at least one of the openings (80) in the handling wall (60) are partially or fully clear, horizontal or lateral air flow can be made available by air passing in through a first unobstructed opening in the handling wall (60) of the handling member (54), through the cavity (106) between the handling wall (54) and the peripheral wall (34), and out through a second unobstructed opening (80) in the handling wall (60) of the handling member (54), (e.g., in a direct or straight path between two or more openings located between the same neighboring septa (84)). Such horizontal ventilation passages can provide another direct route of air flow into and through the closure, such as shown in FIGS. 7A-7D.

Neighboring septa (84) can divide the handling wall (60) into handling wall portions. Where openings (80) are located in the same handling wall portion, a primary horizontal ventilation passage (228) can extend in a straight or direct line through the interior (e.g., the cavity) of the closure (10), air flowing into the closure (10) through a first opening (80) and exiting the closure (10) via a second opening (80). Whereas the primary vertical ventilation passages (222) can define pathways generally parallel to a longitudinal axis of the cap member (20), handling member (54), and/or closure (10), the primary horizontal ventilation passages (228) can define pathways generally perpendicular to a longitudinal axis of the cap member (20).

In some embodiments, the horizontally-oriented ventilation passages can define a ventilation passageway that is not strictly straight or linear, where the airflow is generally horizontal in the sense that a passageway for airflow is provided through a horizontal axis of the closure (10). For example, a primary horizontal ventilation passage (228) can provide air flow into a first opening (80) in the handling member wall, through an interior portion of the closure (10), and out through a second opening (80) in the handling member wall (60), following a contiguous or uninterrupted, but not necessarily straight or direct, path through the closure (10). The horizontal ventilation passages (228) can support air flow in a horizontal direction, but following an indirect pathway through the closure (10).

Closure Structures Supporting Non-Linear Airflow Through the Device.

Figure 9A:
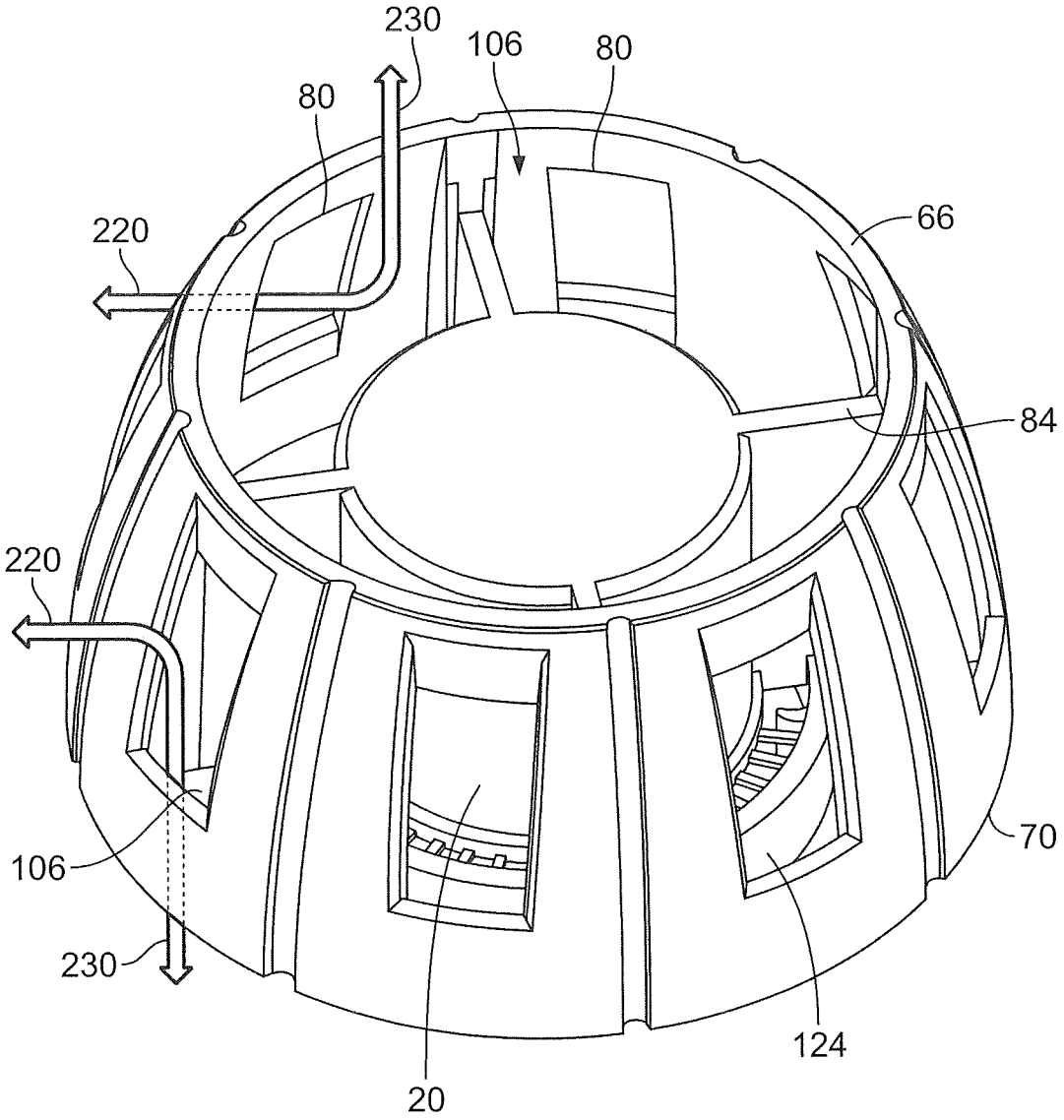
FIGS. 9A-9C show perspective views of a closure (FIGS. 9A-9B) and a cross-sectional view of a closure engaging a fitment (FIG. 9C), illustrating transverse ventilation pathways available for allowing airflow between 1) an opening in a side surface of the closure and an opening in a top surface of the closure defined by an upper handling member rim and between 2) an opening in a side surface of the closure and an opening in a bottom surface of the closure defined by a lower handling member rim.
Figure 9B:
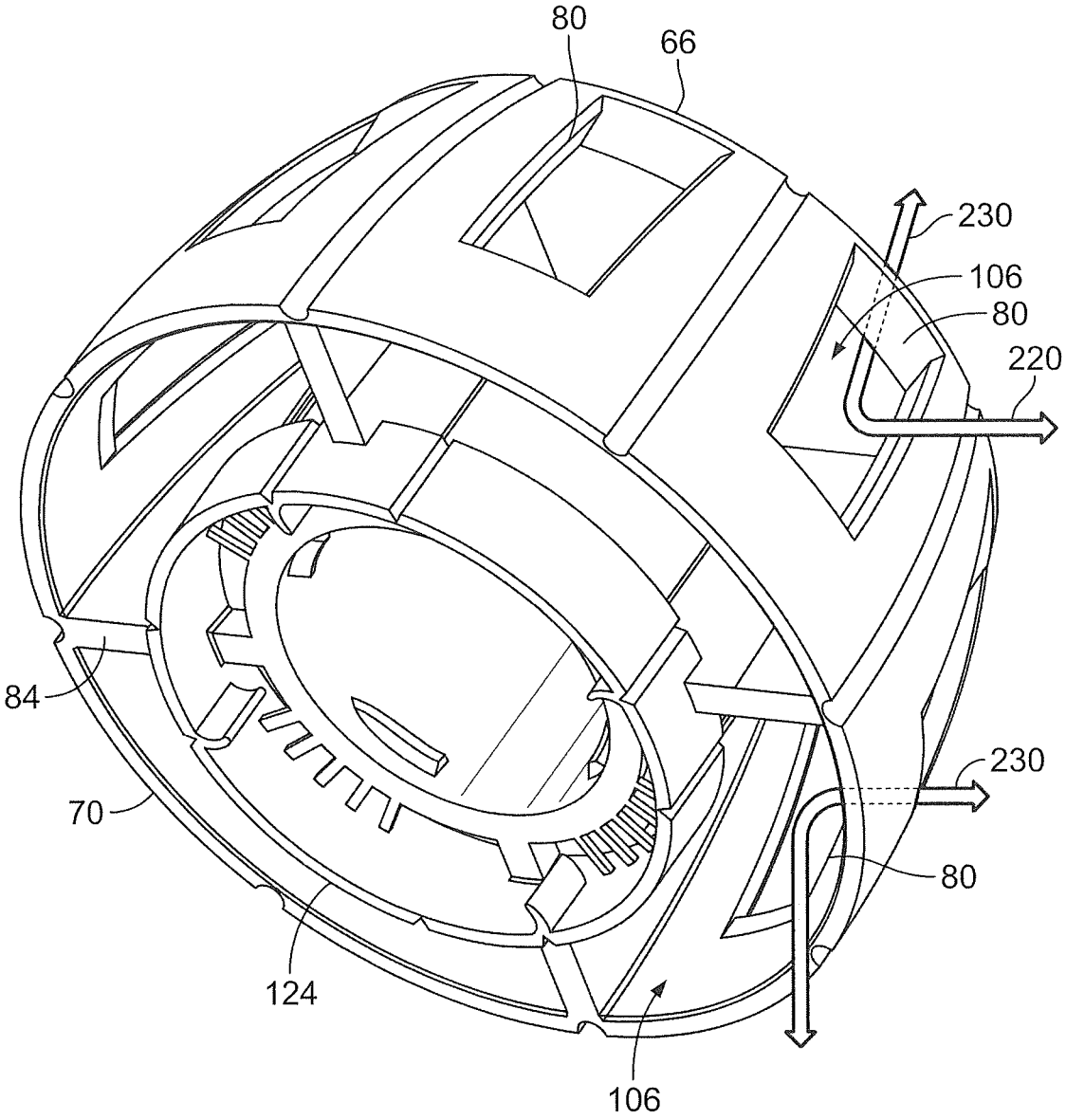
Figure 9C:
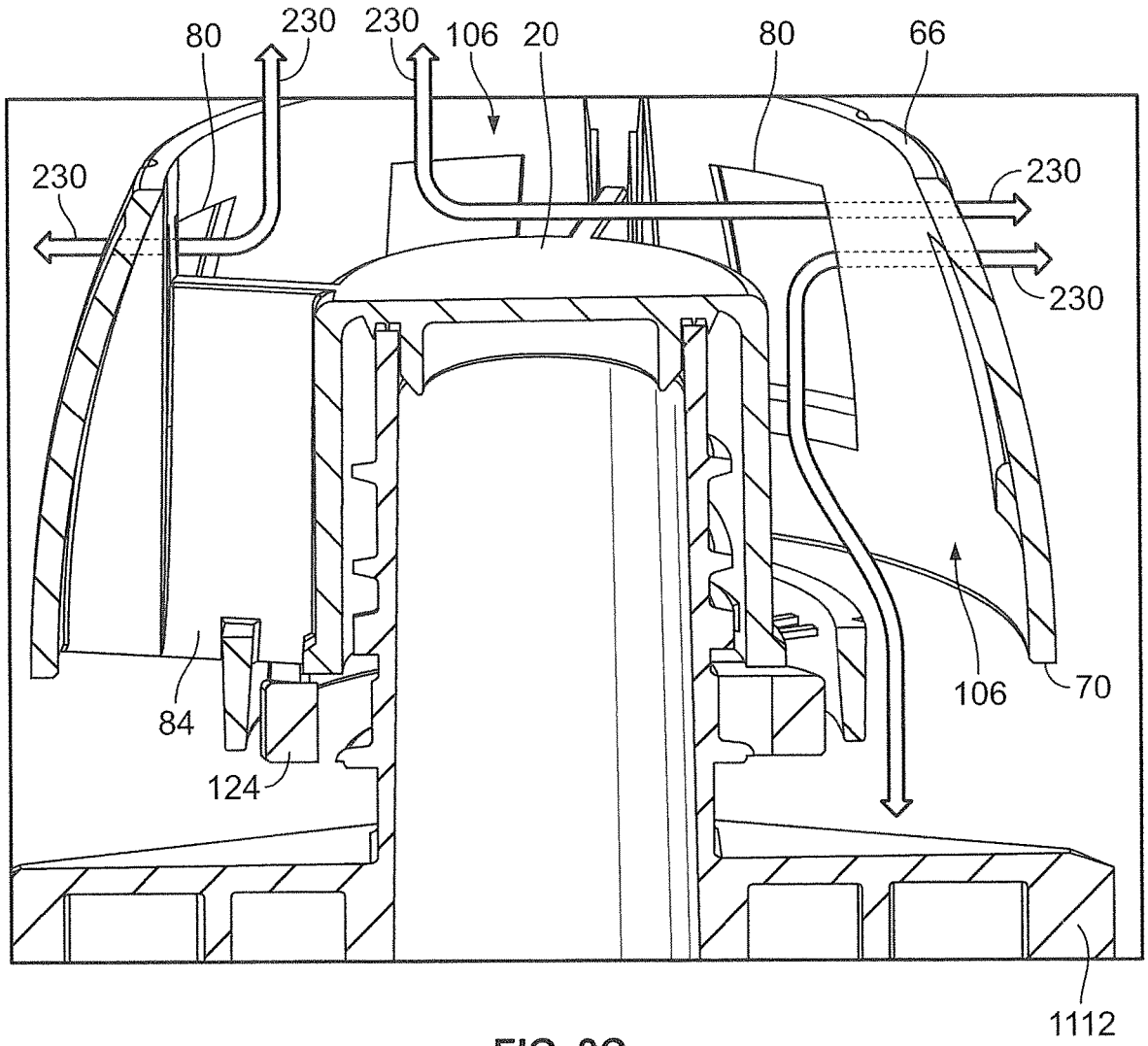

As shown in FIGS. 9A-9C, the topography of the internal structures of the closure (10) can provide transverse ventilation pathways (230)—non-linear pathways for air flow that take advantage of the intersections of the primary (222) and secondary (226) vertical ventilation passages and the horizontal ventilation passages (228) within the cavity (106) or central interior portion (106), to allow air to travel a ventilation route that includes both horizontal and vertical components. For example, air can flow into the cavity (106) via a first end of a primary ventilation passage (e.g., through one of the handling member rims), and where the opposite second end of the primary ventilation passage is obstructed, air can subsequently exit the cavity (106) via an unobstructed opening (80) in the handling wall (60); and vice-versa. As another example, if the bottom side of the closure (10) is obstructed, air could enter the cavity (106) via the top of the primary vertical ventilation passage (222) through the upper handling member rim (66), and then exit the cavity (106) via: i) a neighboring or nearby unobstructed opening (80) in the handling wall (60), ii) traversing over the upper surfaces of the top wall (22) and/or the septa (84) to exit via an opening removed from the air's entry site into the closure (10) (e.g., if a portion of the top and side surfaces of the closure (10) were simultaneously obstructed), or iii) traversing along the outer surface of the peripheral wall (34) and under the lower surfaces of a septum (84) to exit via an the lower handling member rim (70) or an opening (80) removed from the air's entry site into the closure (10); and vice-versa. The multiple entry/exits points into/out of the cavity (106) of the closure (10) enable air flow in a straight line (e.g., through the primary and secondary ventilation passages), or to follow one or more of several winding or angled pathways through the interior of the closure (10), by transferring between connecting portions of the vertical and horizontal ventilation passages.

As the air travels through the cavity (106), it can take an indirect or non-linear path by traversing a pathway over a septum (84) that separates the cap and handling members (54), and/or by traversing a pathway under a septum (84) that separates the cap and handling members (54). In some embodiments, air can travel through an opening or aperture (102) penetrating a portion of the septum (84); providing additional avenues for direct and indirect horizontal ventilation through the closure (10).

As another example, if the top side of the closure (10) were obstructed, air could enter the cavity (106) via the bottom of the primary vertical ventilation passage (222) through the lower handling member rim (70), and then exit the cavity (106) via: i) a neighboring or nearby unobstructed opening (80) in the handling wall (60), ii) traversing past the outer surface of the top wall (22) and/or the lower surface of the septa (84) to exit via the lower handling member rim (70) or an opening (80) removed from the air's entry site into the closure (10) (e.g., if a portion of the bottom and side surfaces of the closure (10) were simultaneously obstructed), or iii) traversing along the outer surface of the peripheral wall (34) and past the upper surfaces of a septum (84) to exit via the upper handling member rim (66) or an opening removed from the air's entry site into the closure (10). Similarly, air could flow through the same structures in opposite directions.

As another example, if both the top (16) and bottom (18) sides of the closure (10) were fully obstructed, air could flow in a lateral direction, in direct or indirect paths into and out of the openings (80) in the handling walls (60). In some situations, where first and second openings (800 are not separated by a septum (84), air could enter through a first opening (80), travel through the cavity (106), and exit through the second opening (80). Where first and second openings (80) are separated by a septum (84), air could enter through a first opening (80) into the cavity (106), then travel around the peripheral wall (34), and above or below the septa (84), to exit via a second opening (80). Where the septa (84) includes an opening (80) or aperture (42), air can travel between septa (84) via such an opening (80) or aperture (42).

The indirect, non-linear ventilation pathways (230) present in the closure (10) define pathways for air flow that facilitate both horizontal and vertical movement of the air as it travels through the closure (10). Where air flow is described moving in a first direction or pathway, air can also travel flow through the same structures in a second, opposite direction.

Additional Features

The components of the closure (10) can be made with a generally rigid material, such as plastic, whereby the entire closure (10), including the tamper-evident band (124), where used, can optionally be injection molded as a unitary element.

The closure (10), and its individual components, can be made in any number of shapes, although it is preferred that the closure (10) be made to have a generally compact or convex shape. Extensive or elaborate surface protrusions or projections are disfavored, so that if the closure (10) is swallowed, then the absence of such structures can make it easier to retrieve the closure (10) from an individual's airway.

As shown in FIGS. 2-3, the closure (10) can occupy a generally discoid volume, with an upper end having a smaller diameter or circumference, or periphery than the opposite lower end. Viewed from the side, the closure (10) can have a generally rectangular or trapezoidal profile, though other shapes (e.g., oval, elliptical, polygonal, irregular, etc.) are envisioned. Viewed from above, the closure (10) can have a shape or profile of any regular polygon, such as a circle, oval, square, rectangle, or hexagon, or an irregular polygon.

Various features of the closure (10) can minimize the amount of material needed to make a closure (10). Certain features create negative spaces in the overall structure of the closure (10), such as grooves (74) in the handling wall (60) and indentations (152) in the tamper-evident ring (124), and define portions of the closure (10) where the material is replaced with space. Thus, less material is required overall in manufacturing the closure (10), providing a closure (10) that is less expensive to make.

Other features, such as a plurality of small, thin connectors in the tamper-evident band (124), compared to a single band encompassing the area, can provide for a version of a closure (10) that requires less materials to make. Similarly, openings (80) can be made in other structures, such as the handling member (54), septa (84), or tamper-evident band (124), to decrease the amount of material required in the closure (10), as well as for increasing the number of ventilation pathways (220) for air through the device.

The foregoing description conveys the best understanding of the objectives and advantages of the present invention. From this description, persons skilled in the art will understand that many modifications and variations can be made without departing from the spirit and scope of the present invention. No limitation with respect to the specific embodiments illustrated is intended. The present invention is intended to be covered by the appended claims, including all such modifications as fall within the scope of the claims.

What is claimed is:

1. A closure for engaging a container, the closure comprising:

(a) a cap member having a top wall, and a peripheral wall depending from the top wall, the cap member for engaging the container;

(b) a handling wall member disposed around the peripheral wall, the handling wall member comprising:

first and second ends, each end having an aperture bounded by a rim, a perimeter of the first end being smaller than a perimeter of the second end; and a plurality of openings in the handling wall member, each opening providing a passageway through a portion of the handling wall member;

(c) a plurality of septa connecting the handling wall member to the peripheral wall;

(d) a first vertical ventilation passage extending in a straight line parallel to a vertical axis of the closure between the peripheral wall and the handling member, the first vertical ventilation passage for conveying air through a top end of the closure, and extending between the top and peripheral walls, and through a bottom end of the closure bottom;

(e) a plurality of second vertical ventilation passages, each second vertical ventilation passage extending in a straight vertical line, each second vertical ventilation passage for conveying air in an unimpeded manner through a corresponding opening, between the handling wall member and the peripheral wall, and through the second end of the handling wall member; and (f) a plurality of horizontal ventilation passages, each first horizontal ventilation passage extending in a straight unobstructed horizontal path between a first one of the plurality of openings and a second one of the plurality of openings for conveying air into the closure via the first opening and out of the closure via the second opening;

wherein, when any one side of the closure is fully obstructed, air can flow freely through the closure through at least one of the ventilation passages.

2. The closure as in claim 1, comprising a plurality of transverse ventilation pathways, wherein at least one transverse ventilation pathway is for conveying air in an indirect path between the first and second openings;

wherein the indirect path includes conveying the air around a septum.

3. The closure as in claim 2, the septum including an upper surface and a lower surface;

wherein the transverse ventilation pathway is for conveying air around the upper and lower surfaces of the septum.

4. The closure as in claim 3, comprising: a tamper-evident band proximate to a bottom of the peripheral wall, comprising:

a plurality of segments joined together to form the band, each end of each segment defining an indentation on an outer surface of the tamper-evident band, each segment attached to the peripheral wall bottom by at least one connecting element; and at least one engagement element i) extending inward from an inner surface of the tamper-evident band and ii) adapted to engage a receptive portion of the container, thereby to cause the tamper-evident band to i) tear along the indentation and ii) separate the segments, for indicating that the container has been disengaged from the closure.

5. The closure as in claim 4, wherein each segment is attached to the peripheral wall bottom by at least one of the following: the at least one connecting element and the septum.

6. The closure as in claim 4, the connecting elements connecting an inner surface of the tamper-evident band to an outer surface of the peripheral wall.

7. The closure as in claim 4, each indentation extends between an upper and lower edge of the band.

8. The closure as in claim 4, the tamper-evident band defining a continuous surface surrounding the bottom end of the peripheral wall.

9. A closure adapted to be engaged to a fitment, or a container having a neck portion configured to accept it, the closure having a top side, a bottom side, and a lateral side between the top and bottom sides, the closure comprising:

(a) a cap member having a top wall, and a peripheral wall depending from the top wall, the cap member for engaging the fitment;

(b) a handling member having:

a handling wall surrounding the peripheral wall;

a top end having an upper handling member rim surrounding a first aperture, and a bottom end having a lower handling member rim surrounding a second aperture, a circumference of the upper handling member rim being smaller than a circumference of the lower handling member rim; and a plurality of openings being located in the handling wall, each of said openings extending between the interior and exterior surfaces of the handling wall, and bounded by the handling wall, each of said openings being located between the top and bottom ends of the; handling member, and each opening defining a passageway for conveying air between the inner and outer surfaces of the handling wall; wherein the peripheral wall and the handling wall define first and second lateral boundaries of a cavity within the closure, an upper end of the cavity defined by the upper handling member rim, and a lower end of the cavity defined by the lower handling member rim;

(c) a septum connecting the handling wall and the peripheral wall to each other;

(d) a first ventilation passage extending in a direct line between the peripheral wall and the handling member, the first ventilation passage for conveying air through the closure top side, the cavity, and the closure bottom side; the first ventilation passage being parallel to a vertical axis of the closure;

(e) a second ventilation passage extending in a direct line through one of said openings, the second ventilation passage for conveying air unimpeded through the handling wall, the cavity, and the closure bottom side, the first and second ventilation passages extending parallel to each other; and (f) a third ventilation passage extending in a direct path between a first one of said openings and a second one of said openings conveying air in the first opening, into the cavity, and unimpeded, to the second one of said openings, the third ventilation passage extending in a direction transverse to first and second ventilation passages;

wherein, when any closure side is fully obstructed, air can flow through the closure through at least one of the first, second, and third ventilation passages.

10. The closure as in claim 9, the septum comprising an upper surface and a lower surface;

wherein the third ventilation passage is for conveying air around the upper and lower surfaces of the septum.

11. The closure as in claim 9, comprising: a tamper-evident band proximate to the bottom end of the peripheral wall, comprising:

a plurality of segments joined together to form a ring, the band having an outer surface and an inner surface;

at least one indentation, each indentation defining an end of the segment; a plurality of connecting elements; each segment attached to at least one of the following: the connecting element and the septum; and at least one engagement element extending toward the peripheral wall and adapted to engage a receptive portion of the fitment, thereby to cause breakage of the tamper-evident band along the at least one indentation, for indicating that the fitment has been disengaged from the closure.

12. The closure as in claim 11, the connecting elements connecting an inner surface of the tamper-evident band to an outer surface of the peripheral wall.

13. The closure as in claim 11, each indentation located on the outer surface of the band, and each indentation extending between an upper and lower edge of the band.

14. The closure as in claim 11, the tamper-evident band defining a continuous surface surrounding the bottom end of the peripheral wall.

15. A closure for engaging a fitment, the closure comprising:

(a) a cap member having a top wall and a peripheral wall depending from the top wall:

(b) a handling wall member encircling the peripheral wall, the handling wall member comprising: first and second ends, a perimeter of the first end being smaller than a perimeter of the second end; and a plurality of openings, each opening located within the handling wall member and between the first and second ends;

(c) a plurality of septa connecting the handling wall member to the peripheral wall, each septa having an upper surface and a lower surface;

(d) at least one first ventilation passage extending between the peripheral wall and the handling member and parallel to a vertical axis of the closure, the first ventilation passage for conveying air through an upper portion of the closure, between the top and peripheral walls, and through a lower portion of the closure;

(e) a plurality of second ventilation passages, the second ventilation passage for conveying air through one of said plurality of openings between the handling wall member and the peripheral wall, through the second end of the handling wall member and parallel to the at least one first ventilation passage; and, (f) a plurality of ventilation pathways transverse to the first and second ventilation passageways, each transverse ventilation pathway for conveying air in a direct and unobstructed path between a first pair of said plurality of openings, the pathway for conveying air around the upper and lower surfaces of the septa, a plurality of connecting elements; and at least one engagement element adapted to engage the fitment, thereby to cause the indentations to tear and the tamper-evident band to separate into segments, for indicating that the closure has been disengaged from the fitment;

wherein, when any one outer surface of the closure is fully obstructed, air can flow through the closure through at least one of the ventilation passages.

16. The closure as in claim 15, comprising a plurality of third ventilation passages, each third ventilation passage extending between a second pair of openings, for conveying air between the second pair of openings.

* * * * *